US007468233B2

(12) United States Patent
Nagayama et al.

(10) Patent No.: US 7,468,233 B2
(45) Date of Patent: Dec. 23, 2008

(54) DEVELOPER FOR USE IN ELECTROPHOTOGRAPHY, IMAGE FORMING METHOD AND PROCESS CARTRIDGE

(75) Inventors: Masashi Nagayama, Numadu (JP); Kimitoshi Yamaguchi, Numadu (JP); Naoki Imahashi, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 483 days.

(21) Appl. No.: 11/222,775

(22) Filed: Sep. 12, 2005

(65) Prior Publication Data

US 2006/0057487 A1 Mar. 16, 2006

(30) Foreign Application Priority Data

Sep. 10, 2004 (JP) ..... 2004-263319
Aug. 23, 2005 (JP) ..... 2005-240531

(51) Int. Cl.
*G03G 9/00* (2006.01)

(52) U.S. Cl. ..... 430/111.4; 430/109.4; 430/111.1; 430/111.33; 430/111.35; 430/111.41; 399/252

(58) Field of Classification Search ..... 430/109.4, 430/111.1, 111.4, 111.41, 111.32, 111.35; 399/252
See application file for complete search history.

(56) References Cited

U.S. PATENT DOCUMENTS 6,743,558 B2 6/2004 Yamaguchi et al.
7,192,679 B2 * 3/2007 Yamaguchi et al. .... 430/111.33
7,419,756 B2 9/2008 Yamashita et al.
2003/0054279 A1 3/2003 Yamaguchi et al.
2003/0096185 A1 5/2003 Yamashita et al.
2005/0064315 A1 3/2005 Yamaguchi et al.
2005/0158643 A1 7/2005 Yamaguchi et al.
2007/0184370 A1 8/2007 Yamashita et al.

FOREIGN PATENT DOCUMENTS

DE 60207923 T2 8/2006
EP 1 255 168 A1 11/2002
JP 3-123361 5/1991
JP 2000-172076 6/2000
JP 2000-250268 9/2000

(Continued)

OTHER PUBLICATIONS

U.S. Appl. No. 11/870,613, filed Oct. 11, 2007, Iwatsuki, et al.

(Continued)

*Primary Examiner*—Mark A Chapman
(74) *Attorney, Agent, or Firm*—Oblon, Spivak, McClelland, Maier & Neustadt, P.C.

(57) ABSTRACT

Electro-photographic images having high picture quality and low carrier adhesion can be obtained using a two-component developer containing a carrier containing (A) a carrier containing a core containing a magnetic material, the core being coated with at least one resin layer; and (B) a toner; wherein the carrier has a weight average particle diameter Dw of 22-32 μm; wherein a content of carrier particles having a diameter smaller than 20 μm is 0-7% by weight based on the weight of the carrier; wherein a content of carrier particles having a diameter smaller than 36 μm is 90-100% by weight based on the weight of the carrier; wherein a weight average particle diameter Dw of the toner is 2-7 μm; and wherein a ratio Dw/Dn of the weight average particle diameter of the toner to the number average particle diameter of the toner is 1.00-1.25.

20 Claims, 5 Drawing Sheets

FOREIGN PATENT DOCUMENTS

| | | |
|---|---|---|
| JP | 2002-091085 | 3/2002 |
| JP | 2002-091143 | 3/2002 |
| JP | 2003-21935 | 1/2003 |
| JP | 2005-250424 | 9/2005 |

OTHER PUBLICATIONS

U.S. Appl. No. 11/958,728, filed Dec. 18, 2007, Nagayama, et al.
U.S. Appl. No. 11/373,109, filed Mar. 13, 2006, Imahashi, et al.
U.S. Appl. No. 11/736,351, filed Apr. 17, 2007, Yamaguchi, et al.
U.S. Appl. No. 11/508,922, filed Aug. 24, 2006, Imahashi, et al.
U.S. Appl. No. 12/048,997, filed Mar. 14, 2008, Yamaguchi, et al.
U.S. Appl. No. 12/040,451, filed Feb. 29, 2008, Saitoh, et al.
U.S. Appl. No. 12/013,108, filed Jan. 11, 2008, Yagi, et al.
Patent Family Search Dated Jun. 19, 2008 for U.S. 6,743,558.
Patent Family Search Dated Jun. 19, 2008 for U.S. 7,192,679.
U.S. Appl. No. 12/015,109, filed Jan. 16, 2008, Nagayama, et al.

* cited by examiner

DEVELOPER FOR USE IN ELECTROPHOTOGRAPHY, IMAGE FORMING METHOD AND PROCESS CARTRIDGE

BACKGROUND OF THE INVENTION

1. Field of the Invention

The present invention relates to an electrophotographic developer, an electrophotographic developing method and a process cartridge for electrophotography.

2. Discussion of the Background

In electrophotography, an electrostatic latent image formed on a photosensitive medium is developed by a developer. One-component developers composed of a toner and two-component developers composed of a toner and a carrier, such as glass beads and magnetic particles with or without resin coating, are known as the developer. Two-component developers are suitably used for high speed printing and copying machines. In digital electrophotography in which a photoconductor is irradiated with a laser beam to form an electrostatic latent image, two-component developers are generally used for developing the latent image.

Recently, there has been an increasing demand for a developer which can meet the requirements of high resolution, improved reproducibility, high image density and of multicolor images. For example, minimization of the smallest unit of latent images and increase in image density of the latent image are desired. Accordingly, there is a great demand for a developer which can accurately and precisely develop a dot image having such properties. To meet this demand, various proposals have been made from the standpoint of both, process conditions of the developing process and the developers (toners and carriers).

As to process conditions, minimization of the developing gap, use of a thin film photoconductor and reduction of the beam diameter for writing are considered to be effective. However, these measures increase cost and reduce reliability.

As for developers, the use of a toner having a small particle size will greatly improve the reproducibility of dot images. However, background stains and reduction of color density occur. Additionally, when a toner having a small particle size and a low softening point resin is used for full color image formation, significant adhesion of the toner particles on the surface of the carrier occurs. The developer deteriorates during use causing toner dispersion and background stains.

The use of a carrier having a small particles size has been suggested. For example, in Japanese Laid-Open Patent application JP 58-144839, it was suggested to use a magnetic carrier having an average particle diameter of less than 30 μm and comprising ferrite particles having a spinel conformation. However, the carrier is not resin coated and is useful for developing in a low electric field. The carrier has inferior developing ability, and has a short life time due to the lack of a resin coating.

In addition, Japanese patent JP 30-29180 discloses a carrier for electro-photography having: a 50% average particle diameter ($D_{50}$) of 15-45 μm, 1-20% of carrier particles smaller than 22 μm, less than 3% of carrier particles smaller than 16 μm, 2-15% of carrier particles larger than 62 μm, less than 2% of carrier particles larger than 88 μm, the carrier particles satisfying the condition of equation (2) wherein $S_1$ is the specific surface area measured by an air permeability method, and $S_2$ is the specific surface area calculated by equation (1).

$$S_2=(6/\rho\cdot D_{50})\times 10^4 \quad \text{(equation 1)}$$

(wherein ρ is the specific gravity of the carrier)

$$1.2\leqq S_1/S_2\leqq 2.0 \quad \text{(equation 2).}$$

When a carrier having a small particle diameter is used, the following advantages are obtained.

[1] Because the surface area per volume is large, such carrier can give enough frictional charging for an individual toner. Therefore, there is little static build-up and reverse static build-up in the toner, and little background fouling occurs. In addition, there is little adhesion and smearing of the toner around a dot, little blurring, and the dot reproducibility is good.

[2] Due to the large surface area per volume and low background fouling, the charging quantity of the toner levels off and an image having a good density can be provided.

[3] Because the carrier has a small particle diameter, a minute magnetic brush can be formed. In addition, because of good flow properties of the tip of the brush, the image has little traces from the tip of the brush.

However, conventional small diameter carriers have a drawback because the carrier particles adhere to the photoreceptor surface, and the adhered carrier causes streaking and fuser roller streaks on the photoconductor. In particular, if the average particle diameter is smaller than 32 μm and the particle size distribution is broad, carrier adhesion occurs, which is disadvantageous.

For stable picture quality, it is important to reduce the dispersion of the charging quantity (charging quantity distribution) of the developer. The charging quantity of the developer is correlated with the size of the toner and the carrier particle size. Therefore, it is possible to reduce the dispersion of the charging quantity by reducing the dispersion of the particle size. This results in a narrow charging quantity distribution.

Japan-Laid Open patent application JP 2002-207309 discloses a toner having a proportion Dw/Dn=1.00-1.20 and a weight average particle diameter Dw=2-6 μm. Using a narrow particle size distribution, the intermolecular force between the electrostatic latent image and the photoconductor becomes constant and the transferal characteristics are improved. Using a small average particle diameter, the quantity of electro static charge of the toner is increased. If the particle size distribution is narrow and the width of the amount of triboelectric distribution is broad, the gray scalability improves. However, if the quantity of the electro static charge of the particle is in inverse proportion to one or two multiples of the particle size and if average particle diameter is decreased, and if the amount of triboelectric distribution is sharp, an improvement of the gray scalability cannot be expected.

Judging from standpoint of stabilization of picture quality, a sharp width of the amount of triboelectric distribution of the developer is preferable. However, the triboelectric distribution amount of the developer is depending on not only the toner but also particle size distribution of the carrier. Therefore, the prescription of the particle size distribution of the toner and the average particle diameter of the toner are not enough to control the triboelectric distribution of developer.

SUMMARY OF THE INVENTION

It is an object of the present invention to provide a developer which can provide stable images having high picture quality.

It is another object of the present invention to provide a developer which does not generate carrier adhesion during the developing and printing process.

It is another object of the present invention to provide a developer for faithfully developing a minimized latent image without carrier adhesion.

It is yet another object of the present invention to provide a developer having a sharp triboelectric distribution which does not fluctuate to obtain further stabilization and high picture quality of the electrophotographic image.

These and other objects of the present invention, either individually or collectively, have been satisfied by the discovery of a two-component developer for electro-photography, comprising:

(A) a carrier comprising a core comprising a magnetic material, said core being coated with at least one resin layer; and (B) a toner;

wherein said carrier has a weight average particle diameter Dw of 22-32 μm;

wherein a content of carrier particles having a diameter smaller than 20 μm is 0-7% by weight based on the weight of the carrier;

wherein a content of carrier particles having a diameter smaller than 36 μm is 90-100% by weight based on the weight of the carrier;

wherein a weight average particle diameter Dw of the toner is 2-7 μm; and wherein a ratio Dw/Dn of the weight average particle diameter of the toner to the number average particle diameter of the toner is 1.00-1.25.

In another embosiemtn, the present invention relates to a method for developing an electro-photographic latent image, comprising:

developing said latent image with the above developer in an electro-photographic imaging apparatus.

In yet another embodiment, the present invention relates to a process cartridge, comprising:

a photo conductor, a charging brush, a development part comprising the above developer, and a blade.

The present invention also relates to an electro-photographic imaging apparatus, comprising:

a photoconductor, a charging means, an image exposure means, a development means, a transfer means, a cleaning means, and a development part comprising the above developer.

BRIEF DESCRIPTION OF THE DRAWINGS

Various other objects, features and attendant advantages of the present invention will be more fully appreciated as the same becomes better understood from the detailed description when considered in connection with the accompanying drawing(s) in which like reference characters designate like corresponding parts throughout and wherein.

DETAILED DESCRIPTION OF THE PREFERRED EMBODIMENTS

Figure 1:
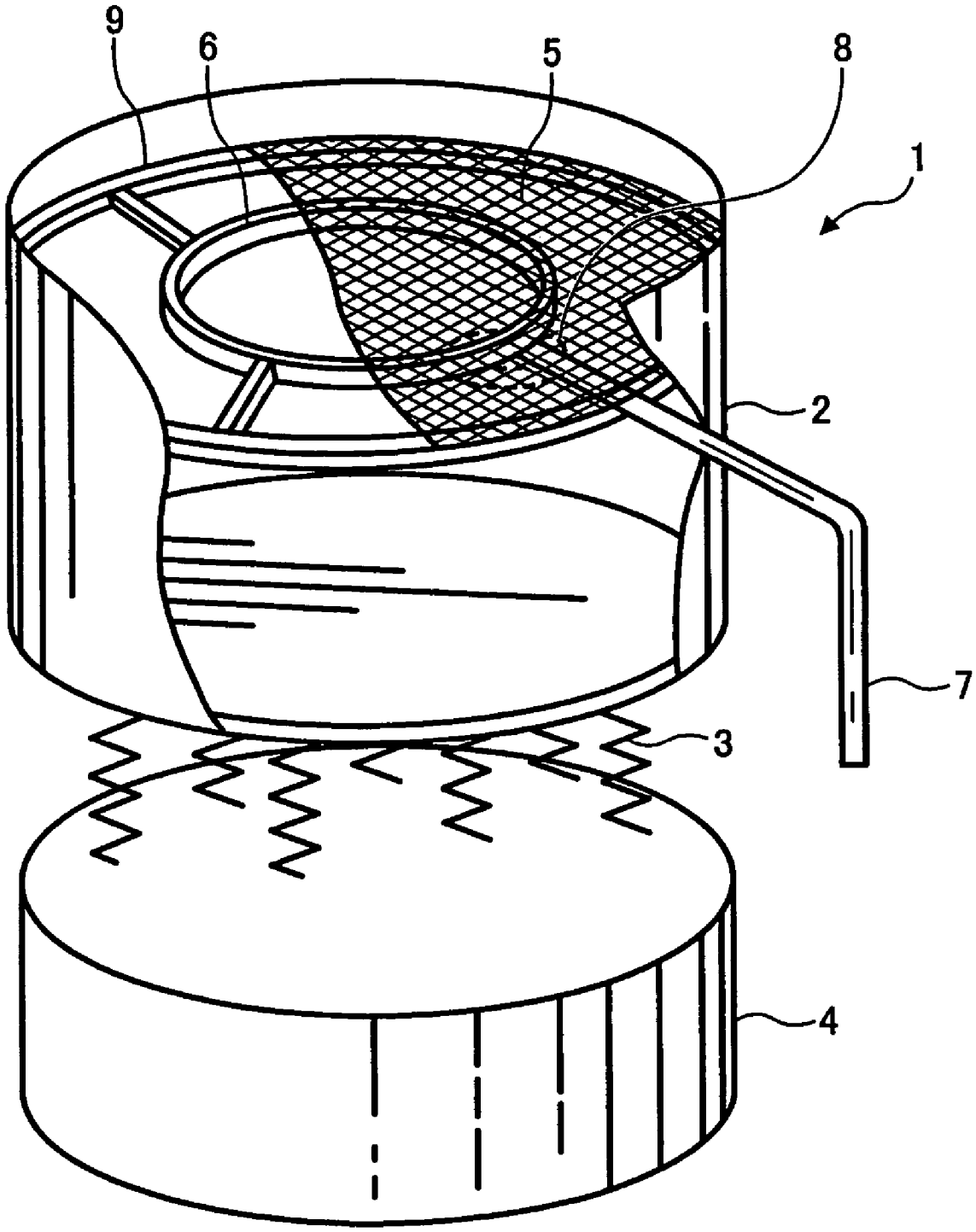
FIG. 1 is a structural drawing of a vibration screen classifier with supersonic wave generator according to the present invention.

The present invention provides a two-component developer for electrophotography comprising (i) a carrier having a resin coated on the surface of a carrier core particle comprising a magnetic substance and (ii) at least a toner. The carrier has a weight average particle size Dw which is 22-32 μm. The content of carrier particles smaller than 20 μm is 0-7% by weight. The content of carrier particles smaller than 36 μm is 90-100% by weight. The weight average particle diameter Dw of the toner is 2-7 μm, and the ratio of Dw/Dn (Dn: number average particle diameter) is 1.00-1.25.

The present invention also provides a developing method for electro-photography using the above developer.

The present invention further provides a developing method for electro-photography using a photoconductor and developing sleeve, wherein the distance between the photoconductor and the developing sleeve is 0.4 mm or less.

The present invention additionally provides a developing method for electro-photography which uses a DC voltage as a developing bias.

Further, the present invention also provides a process cartridge having a photo conductor, a charging brush, a developing part with the above described developer and a blade.

The inventors of the present invention have found that the above objects are satisfied by the discovery of the developer for electro-photography of the present invention having a weight average particle size Dw of the carrier of the developer of 22-32 μm. The weight average particle size Dw of the carrier includes all values and subvalues therebetween, especially including 22.5, 23, 23.5, 24, 24.5, 25, 25.5, 26, 26.5, 27, 27.5, 28, 28.5, 29, 29.5, 30, 30.5, 31, and 31.5 μm. This developer allows faithfully developing a minimized latent image (small dot size) and allows realizing high picture quality. In addition, carrier adhesion is prevented by making the content of particles having a size smaller than 20 μm, 0-7% by weight based on the weight of the carrier, and by making content of particle having a size smaller than 36 μm, 90-100% by weight based on the weight of the carrier. The amount of particles having a size smaller than 20 μm includes all values and subvalues therebetween, especially including 0.5, 1, 1.5, 2, 2.5, 3, 3.5, 4, 4.5, 5, 5.5, 6, and 6.5% by weight. The amount of particles having a size smaller than 36 μm includes all values and subvalues therebetween, especially including 90.5, 91, 91.5, 92, 92.5, 93, 93.5, 94, 94.5, 95, 95.5, 96, 96.5, 97, 97.5, 98, 98.5, 99 and 99.5% by weight.

Carrier adhesion is prevented due to the prescribed weight average particle size and particle size distribution of the carrier as discussed above resulting in improved reproducibility of a minimized latent image and decreased background fouling. In addition, the inventors have found that picture quality can be improved by using a developer with (i) a toner having a prescribed in weight average particle diameter (2-7 μm) and (ii) a prescribed ratio Dw/Dn (1.00-1.25) as described above.

In the present invention, the weight average particle diameter Dw of the toner is 2-7 μm. The weight average particle diameter Dw of the toner includes all values and subvalues therebetween, especially including 2.5, 3, 3.5, 4, 4.5, 5, 5.5, 6, and 6.5 μm. If the weight average particle diameter of the toner is more than 7 μm, the latent image reproducibility decreases and background fouling of the image occurs easily.

If the toner has a weight average particle diameter of less than 2 μm, background fouling of the image occurs easily and over time the stability of the picture quality decreases.

In addition, by prescribing the breadth of particle size distribution of toner and carrier in the developer at the same time, the distribution of the charging quantity of developer becomes narrow and high picture quality can be obtained in a stable manner.

The charging quantity of the particle is correlated to the surface area; and the surface area is proportional to the square of the diameter of the particle. Therefore, the particle diameter is one of the parameters that determine the charging quantity of the particle. Thus, providing a narrow particle size distribution of the toner results in a narrow charging quantity distribution of the toner.

To date, the experiments have been performed to make the charging quantity distribution of the toner and the carrier narrow by narrowing the toner and particle size distribution of carrier in the two-component developer. However, friction charging occurs between toner and carrier on the electrophotographic imaging apparatus in the development with the two-component developer. Therefore, it is necessary to make the toner and carrier particle size distribution narrow at the same time to make charging quantity distribution of toner in the developer narrow.

The inventors of the present invention prescribe a toner particle size distribution and carrier particle size distribution at the same time in order to provide a high quality image in a stable manner, to narrow the charging quantity distribution of the developer by using a developer satisfying these conditions.

In the present invention, the weight average particle size $D_w$ of the carrier in the developer is 22-32 μm, preferably 23-30 μm, more preferably, 23-28 μm.

If the weight average particle size $D_w$ is smaller than 22 μm, carrier adhesion to the image portion or back ground of the latent image occurs easily. If the weight average particle size $D_w$ is larger than 32 μm, carrier adhesion is unlikely to occur. However, a faithful latent image cannot be developed, the variation of the dot diameter increases, and the particulate characteristics get worse.

In addition, when the toner concentration is increased, background fouling occurs easily. Further, the carrier adhesion is a phenomenon in which carrier particles adheres to the image portion or background portion of a latent image. Carrier adhesion is unfavorable because it causes damage of the photoconductor drum and the fixing roller of an electrophotographic imaging apparatus.

In the present invention, the content of carrier having a particle size smaller than 20 μm is lower than 7% by weight based on the carrier quantity in the developer, preferably it is lower than 5% by weight, more preferably lower than 3% by weight.

If the carrier having a particle size smaller than 20 μm is 7% by weight or more, the particle size distribution widens, and small magnetic moment particles exist around the small magnetic brush. As a result, the carrier adhesion is dramatically increased.

In addition, even though not particularly limited, it is preferred that the content of carrier having a particle diameter smaller than 20 μm is bigger than 0.5% by weight based on the carrier quantity in the developer. If the amount of carrier having a particle diameter smaller than 20 μm is 0.5% by weight, the cost of manufacturing of the developer are comparatively low.

If the amount of particles having a diameter smaller than 36 μm is 90% by weight based on the carrier quantity in the developer, preferably 92% by weight, the breadth of the magnetic moment of each particle can be controlled by the granular distribution and the carrier adhesion can be decreased. Still further, if the content of particles having a diameter smaller than 44 μm is more than 98% by weight, the breadth of magnetic moment can be even better controlled and the carrier adhesion can be drastically decreased. If the below described equation (3) is fulfilled, the carrier adhesion bonds in carrier particles or morphology of cut magnetic brush.

$$Fm<Fc \quad \text{(equation 3)}$$

(Fm: magnetic force, Fc: force causing carrier adhesion)

The force Fc causing carrier adhesion is related to the development potential, the background potential, the centrifugal force of carrier, the resistance of carrier and the developer charging quantity. Thus, it is effective to set these parameters to reduce Fc to prevent carrier adhesion. However, since these parameters are closely related to the ability for developing, background fouling and toner scattering, it is difficult to change these parameters drastically. On the other hand, the magnetic force Fm is further described in equation (4).

$$Fm=KM(\partial H/\partial x) \quad \text{(equation 4)}$$

(M: magnetic moment per carrier unit mass).

K is the mass of the carrier. It is expressed in equation (5) described below. In addition, $(\partial H/\partial x)$ is a gradient of the magnetic field strength (H) at the position of the carrier.

$$K=(4/3)\pi\cdot r^3\cdot\rho \quad \text{(equation 5)}$$

(r: radius of the carrier, ρ: true specific gravity of the carrier)

As the magnetic force Fm of the carrier is proportional to the cube of the carrier radius r, the magnetic force Fm decreases at the rate of the cube of particle size. As a result, for carriers of the same average particle diameter, the narrower the particle size distribution and the lower content of small particles is, the less carrier adhesion occurs.

The weight average particle diameter (Dw) of the carrier is calculated by measuring the particle size distributions (showing the relationship between frequencies and numbers of particles by particle diameter-division).

The weight average particle diameter (Dw) is represented by the following equation:

$$Dw=\{1/\Sigma(nD^3)\}\times\{\Sigma(nD^4)\}$$

wherein

D: representative particle diameter in each channel (μm)

n: number of particles in each channel.

The channel mentioned above is a unit for dividing the abscissa axis indicating particle size in the graph showing the entire particle size distribution, and each channel has a 2 μm width in the context of the present invention. In the present invention, the representative particle size of each channel was designated as the smallest size in each channel.

To analyze the particles, the particles having a size of from 8 to 100 μm are divided into 46 units. Each unit is called a "channel" in this application. However, this is not to be confused with "channel black" mentioned below. Each channel's width is 2 μm.

In the present invention, the above-mentioned particle diameters were measured using a MICRO-TRACK PARTICLE SIZE ANALYZER (Model HRA-9320-X 100 manufactured by Honeywell Co. Ltd.), under the following measurement conditions.

(1) scope of particles size: 8 to 100 μm, (2) channel width: 2 μm, (3) number of channels: 46, and (4) particle Refractive Index is 2.42.

The term "carrier deposition" in the context of the present invention refers a phenomenon of depositing a carrier onto an electrostatic latent electrostatic image area or background area.

The carrier of the present invention can be prepared by pulverizing a magnetic material, classifying the finely pulverized particles so as to obtain a core material of particles having the defined particle diameter and preferably the defined distribution in particle diameter of the particles, then providing a film onto the classified magnetic core material. Other ways of making the invention carrier are possible, such as by coating before classifying, etc. Specific examples of core particles for the carrier include Mn—Mg—Sr ferrite, Mn ferrite, Cu—Zn ferrite and magnetite.

The above-mentioned classification includes air classification, sieve classification and the like. Vibration sieves can be used, however, conventional vibration sieves may exhibit mesh clogging for small particles.

In case of classifying very small core particles, the yield of the process of producing the carrier decreases drastically, and becomes about 30%. This is a reason why particles larger than the targets are eliminated from the product.

The inventors of the present invention have developed a method capable of removing small particles with high efficiency, and have found that small particles having a particle diameter of less than 20 μm are removed efficiently and sharply by using ultrasonic waves to vibrate the screen mesh in the sieve classification process. This ultrasonic wave vibration for vibrating the screen mesh can be obtained by giving an electric power of high frequency to a converter (transducer) which uses a PZT vibrator (lead zirconia titanate $PbZrTiO_3$) and converts electric power to ultrasonic wave generating vibration power. In order to make the screen mesh vibrate, the vibration of the ultrasonic wave is transferred to a resonator member.

The direction of the ultrasonic wave vibration of the screen mesh is preferably perpendicular to the plane of its body, and the resonator member is resonated by the vibration of the ultrasonic wave to make the screen mesh vibrate. The frequency of the ultrasonic wave for vibration of the screen mesh preferably ranges from 20 kHz to 50 kHz, more preferably from 30 kHz to 40 kHz. The frequency includes all values and subvalues therebetween, especially including 25, 30, 35, 40 and 45 kHz.

A construction plan of a vibration screen classifier with ultrasonic wave oscillator is shown in FIG. 1. In FIG. 1, the following reference numerals 1-9 have the following meaning:

1 vibration screen classifier, 2 cylindrical vessel, 3 spring, 4 base (support), 5 wire gauze, 6 resonance rings, 7 power source cable, 8 regenerative reactors (a trembler), and 9 ring-shaped frame.

In order to operate the vibrating screen classifier, a high-frequency electric current is supplied to the regenerative reactor (8) using a power source cable (7). The supersonic vibration that occurs in the regenerative reactor (8) is vertical. Due to the vibration of the resonance ring (6), gauze (5) fixed to frame (9) and the resonance ring (6) oscillate in vertical direction with respect to the base (4).

As noted above, the carrier of the present invention can be provided as a core material by classification of particles of a pulverized magnetic material. Alternatively, classification can take place before hand, e.g., sintering in the case of ferrite and magnetite. It is possible to classify after sintering, and core materials can be provided. Classification of particles covered with resin is also possible. At each stage of the core particle production, it is preferably to use the above ultrasonic wave vibration for vibrating the screen mesh.

Samples were made altering the magnetization (M) which influences the magnetic restraint power (Fm) of the carrier. When a magnetic field at 1 kOe is applied to the carrier particle, the magnetization of the carrier particle preferably is more than 70 emu/g, more preferably more than 75 emu/g, and most preferably about 150 emu/g. These preferred values of the magnetization of the carrier particle decrease the carrier adhesion. However, there is no specific limitation on the upper limit of the magnetization of the carrier particle.

Preferably, the magnetization of carrier particle is about 150 emu/g. If the magnetization of the carrier is less than 70 emu/g, carrier adhesion occurs easily. The magnetization of the carrier core particles may be measured with a B-H TRACER (model BHU-60 manufactured by Riken Denshi Kabushiki Kaisha). A sample (1.0 g) is filled in a cylindrical cell and subjected to varying magnetic fields. The magnetic field is gradually increased to 3,000 Oersteds (3 kOe) and then gradually decreased to zero (initial stage). Thereafter, a magnetic field is applied in the opposite direction. Again, the magnetic field is gradually increased to 3 kOe and then gradually decreased to zero (second stage). Subsequently, a magnetic field is gradually increased to 3 kOe in the same direction as in the initial stage (third stage). The B-H curve includes each of the above mentioned stages. The magnetic moment at an applied magnetic field at 1 kOe in the third stage is determined from the B-H curve in which B is the magnetization and H is the applied magnetic filed.

Examples of carrier core materials providing a magnetic moment of at least 50 emu/g when applied with a magnetic field of 1 kOe include ferromagnetic materials such as iron and cobalt, magnetite, hematite, Li ferrite, Mn—Zn ferrite, Cu—Zn ferrite, Ni—Zn ferrite, Ba ferrite and Mn ferrite. Ferrite is a sintered material generally represented by the formula:

$$(MO)x(NO)y(Fe_2O_3)z$$

wherein x+y+z=100 mol %, and M and N are metals such as Ni, Cu, Zn, Li, Mg, Mn, Sr, Ca and other relevant elements, considered to be a perfect mixture of divalent metal oxide and ferric oxide.

More preferable examples of carrier core materials providing magnetization of at least 70 emu/g in a magnetic field of 1 kOe include Fe, magnetite, Mn—Mg—Sr ferrite, and Mn ferrite.

The bulk density of the carrier is preferably greater than or equal to 2.35 g/cm$^3$, more preferably greater than or equal to 2.40 g/cm$^3$ because this is advantageous for preventing carrier adhesion. Carriers having a small bulk density are in general porous or have a surface that is concave-convex. A smaller bulk density of the carrier is more disadvantageous for preventing carrier adhesion because even if the carrier has a large amount of magnetization (emu/g) at 1 kOe of magnetic field, the value of magnetization per particle is reduced. The concave-convex surface causes a variation of the thickness of resin depending on the location. Therefore, unevenness of electric charge and electric resistance depending on location is likely to occur, effecting durability and carrier deposition for long period of running time.

By increasing the sintering temperature, it is possible to enlarge the bulk density of the material. However, when the sintering temperature is increased, core materials melt and agglomerate easily, and do not pulverize easily. Therefore, a bulk density below 2.50 cm$^3$ is preferable, and a preferable range is 2.35 g/cm$^3$ to 2.50 g/cm$^3$, more preferably 2.40 g/cm$^3$ to 2.50 g/cm$^3$. The bulk density includes all values and subvalues therebetween, especially including 2.36, 2.37, 2.38, 2.39, 2.40, 2.41, 2.42, 2.43, 2.44, 2.45, 2.46, 2.46, 2.48, and 2.49 g/cm$^3$.

The density of the present invention is measured as follows. According to JIS-Z-2504, a carrier is made to naturally flow out of an orifice having a diameter of 2.5 mm. The carrier is poured into a 25 cm$^3$ stainless cylindrical container which is located directly below a funnel until the carrier overflows out of the container. Then the carrier is leveled in the container using a horizontal spatula made of nonmagnetic material. If the carrier does not flow easily into an orifice having a diameter of 2.5 mm, an orifice having a diameter of 5 mm is used.

The carrier weight that flowed into the container is divided by the volume of the container (25 cm$^3$), and then the weight of the carrier per 1 cm$^3$ volume is calculated. This is the density of the carrier in the present invention.

The resistivity of the carrier is R (in Ω·cm). Log R of the carrier of the present invention is preferably from 12.0 to 14.0. The Log R includes all values and subvalues therebetween, especially including 12.2, 12.4, 12.6, 12.8, 13, 13.2, 13.4, 13.6 and 13.8 Ω·cm. A Log R of lower than 12.0 is unfavorable because if the developing gap (the most close distance between photosensitive member and development sleeve) becomes narrower, the carrier is electrically charged resulting in increased carrier adhesion. A Log R of more than 14.0 is also unfavorable because an opposite-polarized electric charge is apt to be induced in the carrier, again causing carrier adhesion. The carrier of the present invention having above described resistivity and used in combination with a toner having a relevant amount of electric charge, yields a good image density.

The resistivity of the carrier can be measured as follows. In the description, reference is made to FIG. 2. The reference numerals in FIG. 2 have the following meaning: 11 cell, 12*a* electrode, 12*b* electrode, and 13 carrier.

Figure 2:
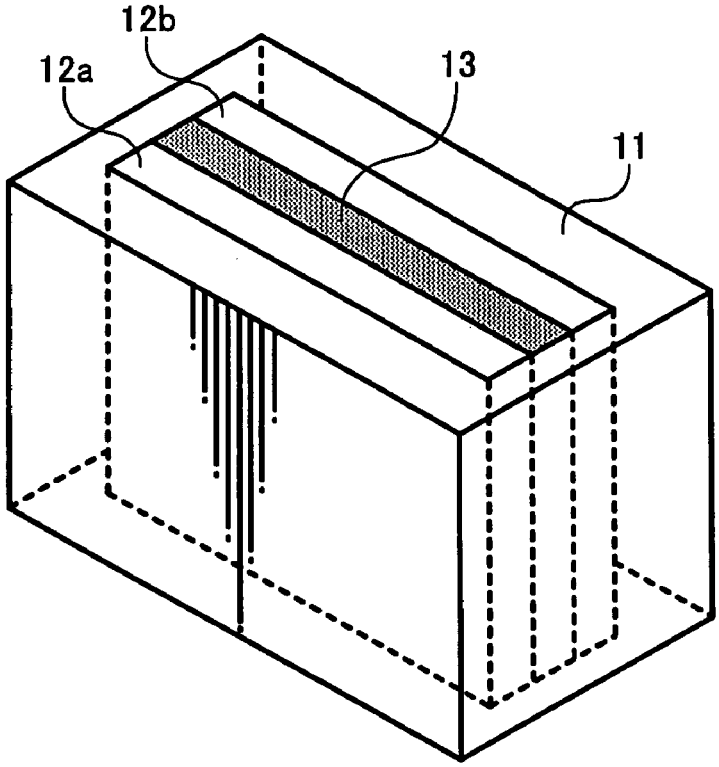
FIG. 2 is a diagrammatic perspective view of a resistance measurement cell for measurement of the electrical resistivity of a carrier.

As shown FIG. 2, carrier (13) was filled in a cell which is made of fluoride resin and contains electrodes (12*a*) and (12*b*) having a 2 mm distance and 2×4 cm of surface area. Then a DC electric voltage of 100 V was applied between the electrodes to determine a DC electric resistance which is measured by a HIGH RESISTANCE METER 4329A (4329A+LJK, 5HVLVWDQFH OHWHU manufactured by Yokogawa Hewlett-Packard Co. Ltd.) and to calculate the resistivity (Log R in Ω·cm) of the carrier.

The resistivity (Log R in Ω·cm) of the carrier can be adjusted by controlling the electric resistivity and layer thickness of the resin which is coated on the carrier core material. Further, it is possible to adjust the resistivity of the carrier by adding a conductive finely divided powder into the coating resin. Preferred conductive finely divided powders are metal or metal oxide powders such as ZnO powder and Al powder, $SnO_2$ prepared by various methods or doped by various elements, borides such as $TiB_2$, $ZnB_2$, $MoB_2$, silicon carbide, conductive polymers such as poly(acethylene), poly(paraphenylene), poly(paraphenylene-sulfide) poly pyrrole, electro-conductive polyethylene, carbon blacks such as furnace black, acethylene black, and channel black.

The conductive finely divided powders may be uniformly dispersed by adding the conductive finely divided powder into a solvent used for coating or a resinous solution for coating. The solvent or solution is then mixed by using a dispersing apparatus or stirrer equipped with paddles which can be operated at a high revolution speed.

According to the present invention, carrier adhesion can be prevented by inducing (bias voltage and effect of development potential) a charge by a low resistivity of a small diameter carrier, if a high resistivity cover layer A is formed on a carrier core surface of the present invention and a low resistivity cover layer B having a resistivity which is lower than that of the high resistivity cover layer A is formed on the high resistivity cover layer A. In addition, back ground fouling is prevented.

A comparison of the adhered carrier particles with average carrier particles shows that the uniformity of the coating layer is bad. In addition, part of the core is exposed in a large number of carrier particles.

When carrier coating becomes heterogeneous, the thickness of the part of the coating layer is decreased and a part of the carrier core is exposed. Low resistivity of carrier core leads to a low resistivity coating layer of the carrier.

The carrier adhesion becomes intense by induction (bias voltage and effect of development potential) of a charge, if there is heterogeneous portion on coating layer of the small diameter carrier having a low resistivity.

Thus, an uniform high resistivity cover layer A is formed first on a carrier core surface and an exposed portion of the core is substantially removed. When a low resistivity cover layer B is formed on the cover layer A, there is little background fouling and little carrier adhesion. $LogR_A$ of the high resistivity cover layer A is not particularly limited but it is preferable 15.5 Ωcm or above (at 500V DC resistivity). In addition, it is preferred that the carrier core is not substantially exposed. The uniformity of cover layer A can be confirmed by fluorescent X-ray. When $LogR_A$ is less than 15.5 Ωcm, the specific resistivity of the carrier core tends to increase.

In the present invention, a examples of resins for cover layer A and cover layer B are conventionally known resins used for the manufacture of carriers, in particular silicone resins as shown if formulae (9 a, b and c) are preferable.

The carrier of the present invention is preferably prepared by providing a resin layer on the surface of the particles of magnetic core material. As resin materials for forming the resin layer, a silicone resin including units of one or more of the formulas represented below is preferably used in the present invention:

Formulae (9 a, b and c)

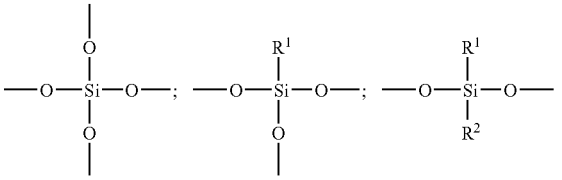

wherein $R^1$ indicates a hydrogen atom, a halogen atom, a hydroxyl group, a methoxy group, a lower alkyl group having 1 to 4 carbon atoms or a aryl group such as a phenyl group or a tolyl group, $R^2$ indicates a lower alkyl group having 1 to 4 carbon atoms or an aryl group such as a phenyl group.

Preferably, $R^1$ is an aryl group having from 6 to 20 carbon atoms, more preferably $R^1$ is an aryl group having from 6 to 14 carbon atoms. Preferred aryl groups are condensed polyaromatic hydrocarbons such as naphthalene, phenanthrene and anthracene, biphenyl and terphenyl, except benzene is not included. The above aryl group may have various substituents.

Unmodified silicone resins can be used as the silicone resin of the present invention. Specific examples of such unmodified silicone resins include KR271, KR272, KR282, KR252, KR255, KR152 (manufactured by Shin-Etsu Chemical Co., Ltd.), SR2400 and SR2406 (manufactured by Dow Corning Toray Silicone Co., Ltd.).

In addition, modified silicone resins can be used to form a resin layer on the carrier of the present invention. Specific examples of such modified silicone resins include an epoxy modified silicone resin, an acryl modified silicone resin, a phenol modified silicone resin, a urethane modified silicone resin, a polyester modified silicone resin and an alkyd modified silicone resin.

Specific examples of the modified silicone resins include ES-1001N (an epoxy modified silicone resin), KR-5208 (an acryl modified silicone resin), KR-5203 (a polyester modified silicone resin), KR-206 (an alkyd modified silicone resin), KR-305 (a urethane modified silicone resin) (all of which are manufactured by Shin-Etsu Chemical Co., Ltd.), SR2115 (an epoxy modified silicone resin) and SR2110 (an alkyd modified silicone resin) (manufactured by Dow Corning Toray Silicone Co., Ltd. for the last two).

Further, it is also possible to use the following resins alone or in combination with the silicone resins mentioned above as resins to form the resin layer on the carrier core: a polystyrene, a chloropolystyrene, a poly-α-methyl styrene, a styrene chlorostyrene copolymer, a styrene-propylene copolymer, a styrene-butadiene copolymer, a styrene-vinylchloride copolymer, a styrene-vinylacetate copolymer, a styrene-maleic acid copolymer, a styrene-acrylic acid copolymer (a styrene-methyl acrylate, a styrene-ethyl acrylate copolymer, a styrene-butyl acrylate copolymer, a styrene-octyl acrylate copolymer, a styrene-phenyl acrylate copolymer, etc.), a styrene-methacrylic acid ester copolymer (a styrene-methyl methacrylate copolymer, a styrene-ethyl methacrylate copolymer, a styrene-butyl methacrylate copolymer, a styrene-phenyl methacrylate copolymer, etc.), a styrene-α-methyl acrylate chloride copolymer, a styrene-acrylic nitrile-acrylic acid ester copolymer, an epoxy resin, a polyester resin, a polyethylene resin, a polypropylene resin, an ionomer resin, a polyurethane resin, a ketone resin, an ethylene-ethyl acrylate copolymer, a xylene resin, a polyamide resin, a phenol resin, a polycarbonate resin, melamine resin, and a fluorocarbon resin.

The method for forming the resin layer on the surface of the carrier core is not particularly limited. Preferred examples include spray drying, dip-coating and powder coating.

The thickness of the resin layer formed on the surface of the carrier core material is from 0.02 to 1 μm, and preferably from 0.03 to 0.8 μm. The thickness of the resin layer includes all values and subvalues therebetween, especially including 0.05, 0.1, 0.2, 0.3, 0.4, 0.5, 0.6, and 0.7 μm. Carriers having good fastness properties can be obtained by incorporating an aminosilane coupling agent into the resin cover layer comprising the above-mentioned silicone resin.

Preferably, the aminosilane coupling agent is used in an amount of from 0.001-30% by weight based on the weight of the silicone resin. The amount of aminosilane coupling agent includes all values and subvalues therebetween, especially including 0.005, 0.01, 0.05, 0.1, 0.5, 1, 5, 10, 15, 20 and 25% by weight based on the weight of the silicone resin. Suitable aminosilane coupling agents for use in the present invention are shown below. They may be used alone or in combination.

| | |
|---|---|
| $H_2N(CH_2)_3Si(OCH_3)_3$ | $M_W$: 179.3 |
| $H_2N(CH_2)_3Si(OC_2H_5)_3$ | $M_W$: 221.4 |
| $H_2N(CH_2)_3Si(CH_3)_2OC_2H_5$ | $M_W$: 161.3 |
| $H_2N(CH_2)_3SiCH_3(OC_2H_5)_2$ | $M_W$: 1913 |

-continued

| | |
|---|---|
| $H_2N(CH_2)_2NHCH_2Si(OCH_3)_3$ | $M_W$: 194.3 |
| $H_2N(CH_2)_2NH(CH_2)_3SiCH_3(OCH_3)_2$ | $M_W$: 206.4 |
| $H_2N(CH_2)_2NH(CH_2)_3Si(OCH_3)_3$ | $M_W$: 224.4 |
| $(CH_3)_2N(CH_2)_3SiCH_3(OC_2H_5)_2$ | $M_W$: 219.4 |
| $(C_4H_9)_2N(CH_2)_3Si(OCH_3)_3$ | $M_W$: 291.6. |

The developer of the present invention comprising a carrier and a toner, preferably has a coverage ratio by the toner for the carrier of from 10% to 90%, preferably from 20% to 80% and more preferably from 30 to 60% by weight based on the weight of the developer. The coverage ratio includes all values and subvalues therebetween, especially including 15, 20, 25, 30, 35, 40, 45, 50, 55, 60, 65, 70, 75, 80 and 85% by weight.

Moreover, in the developer of the present invention, when the coverage ratio by the toner for the carrier is 50%, the toner charge to mass ratio is preferably in the range of from 10 μC/g to 50 μC/g, more preferably from 15 μC/g to 35 μC/g. The toner charge to mass ratio includes all values and subvalues therebetween, especially including 15, 20, 25, 30, 35, 40 and 45 μC/g. If the toner charge to mass ratio is less than 10 μC/g, the background fouling and toner scatter increases. If the toner charge to mass ratio is more than 50 μC/g, the carrier adhesion increases. On the other hand, if the toner charge to mass ratio is less than 35 μC/g, the carrier adhesion is excellent.

The term "covering ratio" used in the present specification refers to a proportion of toner particles of the developer relative to carrier particles of the developer in terms of percentage calculated by the following equation:

$$\text{covering Ratio (\%)}=(Wt/Wc)\times(\rho c/\rho t)\times(Dc/Dt)\times(1/4)\times 100$$

wherein

Wt: the toner weight (g),

Wc: the carrier weight (g),

ρc: specific gravity of the carrier (g/cm$^3$),

ρt: specific gravity of the toner (g/cm$^3$),

Dc: weight average particle diameter of the carrier (μm),

Dt: weight average particle diameter of the toner (μm).

The toner preferably has a weight average particle diameter of not greater than 5.0 μm. The use of such a small particle size toner in conjunction with the above carrier can give high quality images with good dot image reproducibility.

The toner includes a first polyester resin (A) and a second polyester resin (B). It is preferred that the first polyester resin (A) have a glass transition point (Tg) in the range of 65 to 140° C. and a softening point in the range of 65 to 140° C. in order to obtain improved heat resistance and resistance to hot offset. The Tg of the first polyester resin is preferably 90 to 135° C. The softening point of the first polyester resin is preferably 80 to 125° C. The Tg of the first polyester resin includes all values and subvalues therebetween, especially including 70, 75, 80, 85, 90, 95, 100, 105, 110, 115, 120, 125, 130, 135° C. The softening point includes all values and subvalues therebetween, especially including 70, 75, 80, 85, 90, 95, 100, 105, 110, 115, 120, 125, 130, 135° C.

The term "softening point" as used herein is intended to refer to an $F_{1/2}$ temperature measured using a commercially available flow tester of the capillary type, "CFT-500" (Trademark), made by Shimadzu Corporation. A sample of the resin (1 cm$^3$) is placed in a cylinder of the tester provided with a small orifice with a diameter of 1 mm. The temperature of the sample is increased at a rate of 3° C./min while applying a pressure of 10 kg/cm$^2$ to the resin sample to permit the resin sample to flow out through orifice. The height of the sample resin in the cylinder, which decreases as the resin flows through the orifice, is plotted against the temperature. The temperature at which the height of the resin sample in the cylinder has decreased to ½ of the original height (½ of the height from the flow-out initiation point to the flow-out completion point) represents the softening point ($F_{1/2}$ temperature) of the sample resin.

The glass transition point herein is measured using Rigaku THERMOFLEX TG8110 manufactured by Rigaku Denki Co., Ltd. at a heating rate of 10° C. per minute.

The formation of a discrete domain structure can be confirmed by transmission electron microscopy (TEM). Namely, it has been found that the colorant contained in the toner is present in the domains of the second polyester resin, while the domains of the polyester resin (A) are substantially free of the colorant.

Figure 6:
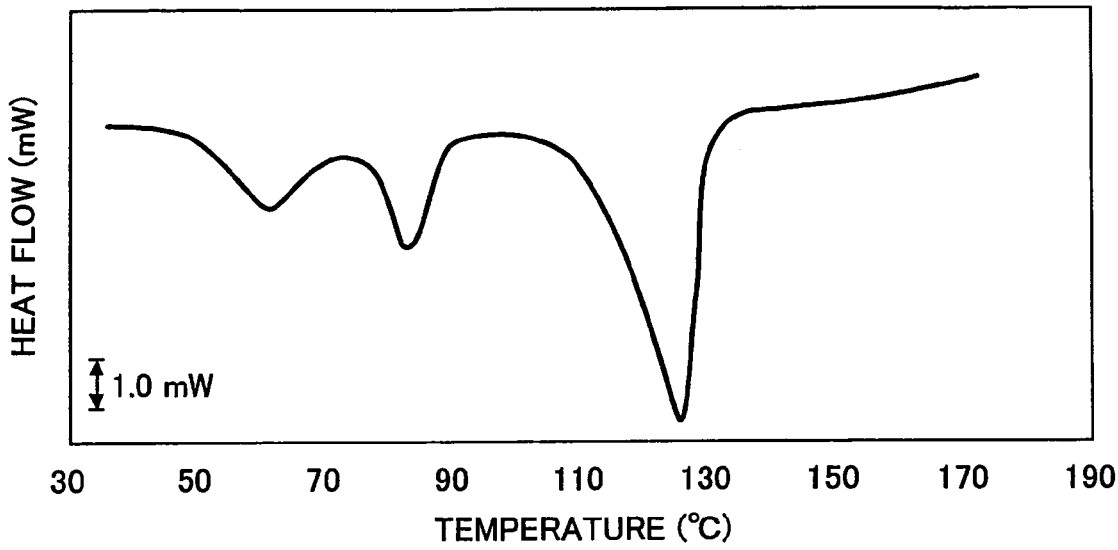
FIG. 6 is a DSC endothermic curve of a toner having phase separation.
Figure 7:
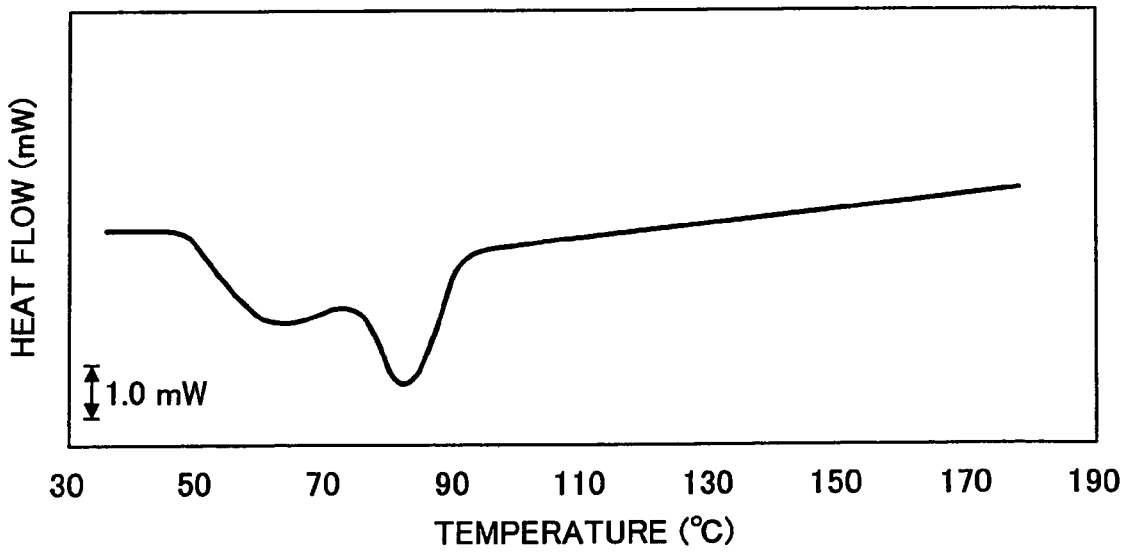
FIG. 7 is a DSC endothermic curve of a toner having no phase separation.

For reasons of improved low temperature fixation efficiency, it is also preferred that the toner have at least three endothermic peaks P1, P2 and P3 in a DSC curve thereof. The endothermic peaks P1, P2 and P3 have peak temperatures of 40 to 70° C., attributed to the polyester resin B, of 70 to 90° C., attributed to the releasing agent and of 90 to 130° C., attributed to the polyester resin A, respectively, as shown in FIG. 6. When the polyester resins A and B do not form discrete domains, the resulting toner gives a DSC curve as shown in FIG. 7.

It is also preferred that the toner show an X-ray diffraction pattern in which at least one peak is present in a region of 2θ of 20 to 25° for reasons of improved low temperature fixation efficiency. More preferably, the toner shows an X-ray diffraction pattern in which peaks are present in at least one of the four regions thereof. Such a toner contains a polyester resin (i.e. polyester resin A) whose crystal phase is not deteriorated by another polyester resin (i.e. second polyester resin) and, thus, whose domain or domains are separated from the domain or domains of the polyester resin B.

It is also preferred that the toner has a dielectric loss in the range of $2.5\times10^{-3}$ to $10.0\times10^{-3}$, more preferably $2.5\times10^{-3}$ to $7.5\times10^{-3}$, for reasons of good chargeability and charge stability. The dielectric loss includes all values and subvalues therebetween, especially including $3\times10^{-3}$, $3.5\times10^{-3}$, $4\times10^{-3}$, $4.5\times10^{-3}$, $5\times10^{-3}$, $5.5\times10^{-3}$, $6\times10^{-3}$, $6.5\times10^{-3}$, $7\times10^{-3}$, $7.5\times10^{-3}$, $8\times10^{-3}$, $8.5\times10^{-3}$, $9\times10^{-3}$, and $9.5\times10^{-3}$. Namely, the toner having the above dielectric loss can be uniformly charged in a stable manner with a sharp distribution of the amount of the charges so that background stains, toner scattering and reduction of quality of images can be suitably prevented.

The dielectric loss herein is measured as follows. First, a sample of toner is formed into a tablet having a thickness of 2 mm and is set on an electrode (model SE-70 manufactured by Ando Denki Co., Ltd.). Using a dielectric-loss measuring device (model TR-10C, manufactured by Ando Electric Co., Ltd.), the dielectric loss is measured with an applied AC current of 1 kHz after the phase separation of polyester (A) and polyester (B) was formed. Uniformity of dispersion of polyester (B) with polyester (A) can be controlled by the manufacturing conditions. For example, uniformity of dispersion can be controlled by kneading the toner produced in a melt-mixer such as a melt-extruder.

It is desirable for the kneading to be performed in low-temperature, the minimum temperature at which the toner melts. If the kneading temperature is too high, polyester (B) chemically reacts with polyester (A) at the time of melt-kneading, and a uniform dispersion of the two resins as well as phase separation cannot be provided. Therefore, the kneading conditions consider the chemical reactivity (solubility parameter) at the $F_{1/2}$ temperature of polyester (A) and polyester (B) and the melt-kneading is performed at a minimum temperature possible in view of the above.

According to the present invention, during the kneading operation of the toner manufacturing process, polyester resin (A) having a low melt viscosity melts and absorbs the shear force when kneading. Therefore, at a high $F_{1/2}$ temperature, an easy to cleave polyester (B) having a high molecular weight can be included without being cleaved. As a result, hot offset characteristics are improved.

The molecular structure of polyester (A) is not particularly limited, but, from the viewpoint of crystallinity of polyester resin and its softening point, it is particularly desirable to prepare the polyester from a diol compound having 2-6 carbon carbon atoms to obtain an aliphatic system polyester (A) represented by formula (1) below. The polyester (A) is prepared from an alcohol component such as 1,4-butanediol, 1,6-hexanediol and their derivatives and an acid component such as maleic acid, fumaric acid, succinic acid and their derivatives.

$$[\text{—O—CO—CR}_1\text{=CR}_2\text{—CO—O—(CH}_2)_n\text{—}]_m \quad (1)$$

n, m are the number of repeating units, n is from 0 to 20, m is from 1 to 20, preferably 1 to 10, and more preferably 1 to 5, $R^1$, $R^2$ are each a hydrogen or a hydrocarbon group, preferably the number of carbon atoms is 1 to 5.

In addition, from the viewpoint of the softening point and crystallinity of the polyester resin (A), a polyalcohol having 3 or more hydroxyl groups such as glycerines is used as an alcohol component. Preferably, branched polyester polyesters are synthesized. Preferably, a polycarboxylic acid having 3 or more carboxylic groups such as anhydrous trimellitic acid ($HOOCC_6H_3(CO)_2O$, m.p. 238° C.) is used as an acid component. The polyester may be obtained by a polycondensation reaction.

Preferably, the polyester resin (A) has a relatively small weight average molecular weight and a relatively sharp molecular weight distribution for reasons of improved low temperature fixation efficiency. Thus, it is preferred that the polyester resin (A) contains o-dichlorobenzene solubles which have a weight average molecular weight Mw of from 5,500 to 6,500, a number average molecular weight Mn of from 1,300 to 1,500 and a ratio (Mw/Mn) of from 2 to 5, according to gel permeation chromatography. Further, the o-dichlorobenzene solubles of the polyester resin (A) preferably have such a molecular weight distribution according to gel permeation chromatography (amount (% by weight) in ordinate vs. molecular weight in abscissa) that a main peak is present in a molecular weight region of $10^{3.5}$ to $10^4$ and that the main peak has a half width value of $10^{1.5}$ or less. The crystalline polyester resin causes a rapid decrease in melt viscosity when heated above the glass transition point thereof and permits low temperature fixation because of a low molecular weight and a sharp molecular weight distribution. It is preferred that the polyester resin have a glass transition point (Tg) in the range of from 90 to 130° C. and a $F_{1/2}$ point in the range of from 80 to 130° C. in order to obtain improved heat resistance and resistance to hot offset. The glass transition temperature includes all values and subvalues therebetween, especially including 95, 100, 105, 110, 115, 120, and 125° C. The $F_{1/2}$ point includes all values and subvalues therebetween, especially including 85, 90, 95, 100, 105, 110, 115, 120, and 125° C. Glass transition temperature (Tg) of the crystalline polyester (A) refers to an endotherm peak temperature of the second temperature rise of the DSC measurement. Tg is determined in the present invention from a 2nd DSC measurement temperature rise using the tangent line method.

If the glass transition temperature (Tg) and the $F_{1/2}$ temperature are less than the above range, synthesis of a crystalline polyester is difficult.

If the glass transition temperature (Tg) and the $F_{1/2}$ temperature exceed 130° C., low-temperature fixibility is not provided because the lower limit of the fixing temperature rises.

The acid value of the polyester resins (A) and (B) are not particularly limited. However, in order to achieve low-temperature fixibility and from the viewpoint of affinity between paper and resin, the acid value is preferably more than 8 mg KOH/g, more preferably more than 20 mg KOH/g. On the other hand, less than 45 mg KOH/g is preferable to improve hot offset resistance. Even more preferably, polyester resins (A) and (B) have an acid value of from 0 to 50 mg KOH/g, more prepferably 5 to 50 mg KOH/g to achieve preferred charging characteristics by which a pre-determined low-temperature fixibility is achieved. The acid value includes all values and subvalues therebetween, especially including 5, 10, 15, 20, 25, 30, 35, 40 and 45 mg KOH/g.

Preferably, the polyester resin (A) exhibits an X-ray diffraction pattern in which at least one peak is present in a region of 2θ of 20 to 25° for reasons of improved low temperature fixation efficiency. More preferably, polyester resin (A) exhibits an X-ray diffraction pattern in which peaks are present in at least one of the four regions, more preferably in each of the four regions of 2θ of 19-20°, 21-22°, 23-25° and 29-31° for reasons of improved low temperature fixation efficiency.

The toner according to the present invention is not particularly limited. To produce low-temperature fixibility, the toner preferably includes 1-50 parts by weight of polyester resin (A) based on the weight of the toner. The amount of polyester resin (A) includes all values and subvalues therebetween, especially including 5, 10, 15, 20, 25, 30, 25, 40 and 45 parts by weight based on the weight of the toner. If the content of polyester resin (A) is less than 1 part by weight, low-temperature fixibility decreases. Hot offset characteristics decrease if more than 50 parts by weight are used, and colorant dispersion characteristics decrease so a pigment does not disperse in polyester (A). In addition, when using carbon black as a pigment, the volume specific resistance of the toner falls remarkably if the content of polyester resin (A) is too high.

The $F_{1/2}$ temperature of polyester resin (B) is preferably 120-160° C. The $F_{1/2}$ temperature includes all values and subvalues therebetween, especially including 125, 130, 135, 140, 145, 150, and 155° C. For reasons of satisfactory hot offset resistance, the polyester resin (B) preferably has a softening point of at least 120° C. From the standpoint of energy saving at the time of toner manufacturing, especially thermal energy required during kneading and electric energy required during kneading and pulverization, the softening point of the polyester resin (B) is preferably not higher than 160° C.

The polyester resin (B) preferably has a Tg (glass transition point) of 40 to 70° C., for reasons of satisfactory heat resistance and low temperature fixation efficiency. The Tg includes all values and subvalues therebetween, especially including 45, 50, 55, 60, 65° C. If the glass transisition temperature (Tg) is equal to or less than 40° C., the heat resistance properties of the toner decrease remarkably and blocking occurs, e.g. the toner particles adhere to each other, in other words, the toner cakes. If the glass transition temperature (Tg) is more than 70° C., the low temperature fixibility of the toner decreases. Tg is determined in the present invention from a 2nd DSC measurement temperature rise using the tangent line method.

The molecular structure of polyester resin (B) is not particularly limited. The alcohol component is preferably bisphenol A adduct with propylene oxide, or a bisphenol A adduct with ethylene oxide. The acid is preferably terephthalic acid, dodecenyl succinic anhydride, or anhydrous trimellitic acid. It is preferable for the acid not to comprise unsaturated carbon-carbon double bonds. Unsaturated carbon-carbon double bonds in the polyesters (A) and (B) may result in crosslinking during the melt-kneading process of the toner manufacturing process which is undesirable. Even more preferably, polyester resin (B) forms a gel with chloroform which is insoluble to achieve enough hot offset resistance.

It is preferable for weight average particle size (Dw) of a toner of the present invention to be 2-7 μm, and it is preferable for a ratio (Dw/Dn) in which Dn is the number average particle diameter to be 1.00-1.25. By prescribing Dw/Dn in this way, it is possible to obtain high quality images. In addition, the following conditions are preferred to obtain high quality images.

The weight average particle size (Dw) is preferably 3-6 μm and Dw/Dn is preferably 1.00≦1.20 and the amount of particles having a diameter of less than or equal to 3 μm is 1-10% by number. More preferably, Dw/Dn is 1.00≦1.15. A toner having the above characteristics can be used for a long period of time with little particle diameter fluctuation.

During long-term use in the development apparatus, good development characteristics are provided over a long period of time. In addition, the charging quantity distribution of the developer is achieved by prescribing fineness breadth of the distribution of toner and carrier in developer at the same time as discussed above and high picture quality can be achieved.

The weight average particle size of the toner can be measured by various methods. In the present invention, except the case of particles having a diameter of less than or equal to 3 μm, it was measured in COULTER MULTI-SIZER II made in Coulter Corporation.

The amount of particles having a diameter of 3 μm or below is measured by a flow-type particle image analyzer FPIA-2000 from TOA Medical Electric SYSMEX CORPORATION. A specific measuring method includes adding 2 to 20 mg of a surfactant, preferably an alkyl benzene sulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid and measuring the toner size and distribution with the above-mentioned analyzer.

The toner particles may be subjected to solid $C^{13}$-NMR analysis using FT-NMR SYSTEM JNM-AL400 (trade name, a product of JEOL) under the conditions of:

observed nuclide: $C^{13}$, reference substance: adamantane, integration times: 8192, pulse series: CPMAS, IRMOD: IRLEV, measurement frequency: 100.40 MHz, OBSET: 134500 Hz, POINT: 4096, PD: 7.0 sec, SPIN: 6088.

Chem Draw Pro Ver. 4.5 can be used as a software for the elucidation of the molecular structure.

The structure of the toner can be verified, for example, in the following manner. Specifically, a resin embedding toner particles is very finely sliced so as to yield an ultrathin section having a thickness of about 100 μm. The toner particles within the ultrathin section are dyed with ruthenium tetroxide. The ultrathin slice is observed under a transmission electron microscope (TEM) at an acceleration voltage of 300 kV at a magnification of about 10,000, and pictures of the toner particles are taken and are visually observed.

$F_{1/2}$ Temperature

In the present invention, the $F^{1/2}$ temperature of a resin is measured using a flow tester CFT-500 manufactured by Shimadzu Corp. The conditions for the measurement using the flow tester are as follows:

(1) diameter of the die: 1 mm, (2) pressure applied to the sample: 10 kg/cm$^2$, (3) temperature rising speed: 3° C./min.

The $F_{1/2}$ temperature of a resin is defined as the mid-temperature of the starting temperature of the flow of the resin and the ending temperature of the flow of the resin when the resin is subjected to a heat analysis using the flow tester.

Glass Transition Temperature (Tg)

The glass transition temperature of a resin is measured with an instrument THERMOFLEX TG8110 manufactured by RIGAKU CORPORATION. The measurements are performed at a temperature rising speed of 10° C./min.

Acid Value

The acid value and a hydroxyl value of the resin are determined based on the methods specified in JIS K0070. However, if a sample does not dissolved, solvents such as dioxane, THF and o-dichlorobenzene are used.

Powder X-Ray Diffraction

RINT1100 having a Cu bulb and a tube voltage of 50 kV and a current of 30 mA, and a wide-angle goniometer were used to measure the powder X-ray diffraction.

Pulverizability

An air pulverizer was used to pulverize the toner material in fixed conditions and the pulverized particle diameter was measured. The smaller the particle diameter, the better the pulverizability.

Specific Examples of the Toner Material.

Polyester resins are prepared by subjecting an alcohol and a carboxylic acid to a polycondensation reaction. Specific examples of the alcohol include glycols such as ethylene glycol, diethylene glycol, triethylene glycol, and propylene glycol; etherified bisphenols such as bisphenol A; 1,4-bis (hydroxymethyl) cyclohexane; alcohols having two hydroxyl groups; and polyhydric alcohols having three or more hydroxyl groups.

Specific examples of the carboxylic acids include dibasic organic acids such as maleic acid, fumaric acid, phthalic acid, isophthalic acid, terephthalic acid, succinic acid, and malonic acid; polybasic carboxylic acids having three or more carboxyl groups, such as 1,2,4-benzenetricarboxylic acid, 1,2,5-benzenetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

Polyester resins having a glass transition temperature of 55° C. or more, more preferably 60° C. or more are preferably used as the binder resin of the toner of the present invention.

Suitable polyols (PO) include diols (DIO) and polyols (TO) having three or more hydroxyl groups. It is preferable to use a DIO alone or mixtures in which a small amount of a TO is mixed with a DIO.

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of a bisphenol with an alkylene oxide are preferable. More preferably, adducts of a bisphenol with an alkylene oxide, or mixtures of an adduct of a bisphenol with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferable to use dicarbxoxylic acids (DIC) alone or mixtures in which a small amount of a TC is mixed with a DIC.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (TC), anhydrides or lower alkyl esters (e.g., methyl esters, ethyl esters or isopropyl esters) of the polycarboxylic acids mentioned above can be used for the reaction with a polyol.

A suitable mixing ratio (i.e., an equivalence ratio [OH]/[COOH]) of a polyol (PO) to a polycarboxylic acid (PC) is from 2/1 to 1/1, preferably from 1.5/1 to 1/1 and more preferably from 1.3/1 to 1.02/1.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophoronediisocyanate and cyclohexylmethane diisocyanate); aromatic diisocyanates (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

A suitable mixing ratio (i.e., [NCO]/[OH]) of a polyisocyanate (PIC) to a polyester having a hydroxyl group is from 5/1 to 1/1, preferably from 4/1 to 1.2/1 and more preferably from 2.5/1 to 1.5/1. If the [NCO]/[OH] ratio is too large, the low temperature fixability of the toner deteriorates. In contrast, if the ratio is too small, the content of the urea group in the modified polyesters decreases and thereby the hot offset resistance of the toner deteriorates. The content of the polyisocyanate unit (PIC) in the polyester (A) prepolymer having terminal polyisocyanate group is from 0.5 to 40% by weight, preferably from 1 to 30% by weight and more preferably from 2 to 20% by weight based on the weight of the polyester (A)

prepolymer. The content of the PIC unit includes all values and subvalues therebetween, especially including 5, 10, 15, 20, 25, 30 and 35% by weight based on the weight of the polyester (A) prepolymer.

By reacting the polyester (A) prepolymer having an isocyanate group with an amine (AM), a urea-modified polyester resin (UMPE) can be prepared. This UMPE can be preferably used as the toner binder.

Specific examples of the amines (AM) include diamines (AM1) polyamines (AM2) having three or more amino groups, amino alcohols (AM3), amino mercaptans (AM4), amino acids (AM5) and blocked amines (AM6) based on amines (AM1-AM5).

Specific examples of the diamines (AM1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine and hexamethylene diamine); etc.

Specific examples of the polyamines (AM2) having three or more amino groups include diethylene triamine, triethylene tetramine.

Specific examples of the amino alcohols (AM3) include ethanol amine and hydroxyethyl aniline. Specific examples of the amino mercaptan (AM4) include aminoethyl mercaptan and aminopropyl mercaptan. Specific examples of the amino acids (AM5) include amino propionic acid and amino caproic acid.

Specific examples of the blocked amines (AM6) include ketimine compounds which are prepared by reacting one of the amines AM1-AM5 mentioned above with a ketone such as acetone, methyl ethyl ketone and methyl isobutyl ketone; oxazoline compounds, etc. Among these compounds, diamines (AM1) and mixtures in which a diamine (AM1) is mixed with a small amount of a polyamine (AM2) are preferable.

The molecular weight of the urea-modified polyesters can be controlled using an molecular weight control agent, if desired. Specific examples of the molecular weight control agent include monoamines (e.g., diethylamine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the prepolymer (A) having an isocyanate group to the amine (AM) is from 1/2 to 2/1, preferably from 1.5/1 to 1/1.5 and more preferably from 1.2/1 to 1/1.2.

In the present invention, when the above-mentioned polyester resin and prepolymer are included in a toner as a binder and chloroform-insoluble components of the toner are in the above-mentioned range, resins besides the polyester resin can also be used in combination therewith.

Specific examples of the additional resins include styrene resins (styrene or styrene polymers and substituted styrene polymers) such as polystyrene, chloropolystyrene poly-α-methylstyrene, styrene-chlorostyrene copolymers, styrene-propylene copolymers, styrene-butadiene copolymers, styrene-vinylchloride copolymers, styrene-vinylacetate copolymers, styrene-maleate copolymers, styrene-acrylate copolymers (styrene-methylacrylate copolymers, styrene-ethylacrylate copolymers, styrene-butylacrylate copolymers, styrene-octylacrylate copolymers, styrene-phenylacrylate copolymers, etc.), styrene-methacrylate copolymers (styrene-methylmethacrylate copolymers, styrene-ethylmethacrylate copolymers, styrene-butylmethacrylate copolymers, styrene-phenyl methacrylate copolymers, etc.), styrene-α-chloro methyl acrylate copolymers and styrene-acrylonitrile-acrylate copolymers; vinylchloride resins; styrene-vinylacetate resins; rosin-modified maleic acid resins; phenol resins; epoxy resins; polyethylene resins; polypropylene resins; ionomer resins; polyurethane resins; silicone resins; ketone resins; ethylene-ethylacrylate resin; xylene resins; polyvinylbutyral resins; petroleum resins; and petroleum resins including a hydrogen atom.

Methods of preparing these resins are not particularly limited, and any methods such as solid polymerization, solution polymerization, emulsion polymerization and suspension polymerization can be used.

Colorant

Suitable colorants for use in the toner of the present invention include known dyes and pigments. Specific examples of the colorants include carbon black, nigrosine dyes, black iron oxide, naphthol yellow S, HANSA YELLOW (10G, 5G and G), cadmium yellow, yellow iron oxide, loess, chrome yellow, titan yellow, polyazo yellow, oil yellow, hansa yellow (GR, A, RN and R), pigment yellow L, benzidine yellow (G and GR), permanent yellow (NCG), vulcan fast yellow (5G and R), tartrazine lake, quinoline yellow lake, anthrazane yellow BGL, isoindolinone yellow, red iron oxide, red lead, orange lead, cadmium red, cadmium mercury red, antimony orange, permanent red 4R, para red, fire red, p-chloro-o-nitroaniline red, lithol fast scarlet G, brilliant fast scarlet, brilliant carmine BS, permanent red (F2R, F4R, FRL, FRLL and F4RH), fast scarlet VD, vulcan fast rubine B, brilliant scarlet G, lithol rubine GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobaltblue, ceruleanblue, alkali blue lake, peacock blue lake, victoria blue lake, metal-free phthalocyanine blue, phthalocyanine blue, fast sky blue, indanthrene blue (RS and BC), indigo, ultramarine, prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc oxide, lithopone and the like. These materials may be used alone or in combination.

The content of the colorant in the toner is preferably from 1 to 30% by weight, and more preferably from 3 to 20% by weight, based on the total weight of the toner. The amount of colorant includes all values and subvalues therebetween, especially including 5, 10, 15, 20 and 25% by weight, based on the weight of the toner.

Master batch pigments, which are prepared by combining a colorant with a resin, can be used as the colorant of the toner composition of the present invention. Specific examples of the resins for use in the master batch pigments or for use in combination with master batch pigments include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl-α; -chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins may be used alone or in combination.

The master batch for use in the toner of the present invention is typically prepared by mixing and kneading a resin and a colorant upon application of high shear stress thereto. In this case, an organic solvent can be used to increase the interaction of the colorant with the resin. In addition, flushing methods can be used in which an aqueous paste including a colorant is mixed with a resin solution of an organic solvent to transfer the colorant to the resin solution. Then, the aqueous liquid and organic solvent are separated to be removed. Such methods can be preferably used because the resultant wet cake of the colorant can be used as it is. In this case, three-roll mills can be preferably used for kneading the mixture upon application of high shear stress thereto.

A release agent may be included in the toner of the present invention. Suitable release agents include known waxes.

Specific examples of the release agent include polyolefin waxes such as polyethylene waxes and polypropylene waxes; long chain hydrocarbons such as paraffin waxes and SAZOL waxes; waxes including a carbonyl group, etc. Among these waxes, the waxes including a carbonyl group are preferably used.

Specific examples of the waxes including a carbonyl group include polyalkane acid esters such as carnauba wax, montan waxes, trimethylolpropane tribehenate, pentaerythritol tetrabehenate, pentaerythritol diacetate dibehenate, glycerintribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these materials, polyalkane acid esters are preferable.

The waxes for use in the toner of the present invention preferably have a melting point of from 40 to 160° C., more preferably from 50 to 120° C., and even more preferably from 60 to 90° C. The melting point includes all values and subvalues therebetween, especially including 45, 50, 55, 60, 65, 70, 75, 80, 85, 90, 95, 100, 105, 110, and 115° C. If the melting point of the wax included in the toner is too low, the high temperature resistance of the toner deteriorates. In contrast, if the melting point is too high, a cold offset problem occurs, meaning that an offset phenomenon occurs at a low fixing temperature.

The wax used in the toner of the present invention preferably has a melt viscosity of from 5 to 1000 cps and more preferably from 10 to 100 cps at a temperature 20° C. higher than the melting point of the wax. The melt viscosity includes all values and subvalues therebetween, especially including 50, 100, 200, 300, 400, 500, 600, 700, 800 and 900 cps. If the melt viscosity is too high, the effect of improving the hot offset resistance and low temperature fixability is decreased. The content of the wax in the toner is from 0 to 40% by weight and preferably from 3 to 30% by weight based on total weight of the toner. The amount of wax includes all values and subvalues therebetween, especially including 5, 10, 15, 20, 25, 30 and 35% by weight based on the weight of the toner.

Charge Controlling Agent

A charge controlling agent may be included in the toner of the present invention. Specific examples of the charge controlling agent include known charge controlling agents such as nigrosine dyes, triphenylmethane dyes, metal complex dyes including chromium, chelate compounds of molybdic acid, rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the commercially available charge controlling agents include BONTRON 03 (nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and the toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. The amount of charge control agent includes all values and subvalues therebetween, especially including 0.5, 1, 1.5, 2, 2.5, 3, 3.5, 4, 4.5, 6, 6.5, 7, 7.5, 8, 8.5, 9 and 9.5 parts by weight based on the weight of the toner. If the content is too high, the toner the charge quantity of the toner is too large, and thereby the electrostatic force of a developing roller attracting the toner increases, resulting in deterioration of the fluidity of the toner and decrease of the image density of toner images.

The charge controlling agent can be dissolved or dispersed in an organic solvent after kneading together with a master batch pigment and resin. In addition, the charge controlling agent can be directly dissolved or dispersed in an organic solvent when the toner constituents are dissolved or dispersed in an organic solvent. Alternatively, the charge controlling agent may be fixed on the surface of the toner particles after the toner particles are prepared.

The thus prepared toner particles may be mixed with an external additive to assist in improving the fluidity, developing property and charging ability of the toner particles. Suitable external additives include particulate inorganic materials. It is preferable for the particulate inorganic materials to have a primary particle diameter of from 5 nm to 2 μm, and more preferably from 5 nm to 500 nm. The primary particle diameter includes all values and subvalues therebetween, especially including 10, 50, 100, 200, 300, 400, 500, 600, 700, 800, 900 nm, 1, 1.1, 1.2, 1.3, 1.4, 1.5, 1.6, 1.7, 1.8 and 1.9 μm. In addition, it is preferable that the specific surface area of such particulate inorganic materials measured by a BET method is from 20 to 500 $m^2/g$. The specific surface area includes all values and subvalues therebetween, especially including 50, 100, 150, 200, 250, 300, 350, 400 and 450 $m^2/g$. The content of the external additive is preferably from 0.01 to 5% by weight, and more preferably from 0.01 to 2.0% by weight, based on total weight of the toner. The content of the external additive includes all values and subvalues therebetween, especially including 0.05, 0.1, 0.5, 1, 1.5, 2, 2.5, 3, 3.5, 4 and 4.5% by weight based on the weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, particles of polymers such as polymers and copolymers of styrene, methacrylates, acrylates or the like; polymers prepared by polycondensation polymerization, such as silicone resins, benzoguanamine resins and nylon resins; and thermosetting resins, which can be prepared by a soap-free emulsion polymerization method, a suspension polymerization method or a dispersion method, can also be used as the external additive.

These materials for use as the external additive can be subjected to a surface treatment to be hydrophobized, thereby preventing the fluidity and charge properties of the toner even under high humidity conditions. Specific examples of the hydrophobizing agents include silane coupling agents, silylation agents, silane coupling agents including a fluoroalkyl group, organic titanate coupling agents, aluminum coupling agents, silicone oils, modified silicone oils, etc.

The toner of the present invention may include a cleaning ability improving agent to improve the cleaning ability thereof such that the toner remaining on an image bearing member such as photoreceptors and intermediate transfer belts can be easily removed therefrom. Specific examples of the cleaning ability improving agents include fatty acids and metal salts thereof such as zinc stearate, calcium stearate and stearic acid; polymer particles which are prepared by a soap-free emulsion polymerization method or the like, such as polymethyl methacrylate particles and polystyrene particles; etc. The polymer particles preferably have a narrow particle diameter distribution and the volume average particle diameter thereof is preferably from 0.01 to 1 μm. The volume average particle diameter includes all values and subvalues therebetween, especially including 0.05, 0.1, 0.2, 0.3, 0.4, 0.5, 0.6, 0.7, 0.8 and 0.9 μm.

Further, the toner of the present invention can be used as a magnetic toner when a magnetic material is included therein. Specific examples of the magnetic materials include iron oxides such as magnetite, hematite and ferrite; metals such as cobalt and nickel; or their metal alloys and mixtures with aluminum, copper, lead, magnesium, tin, zinc, antimony, beryllium, bismuth, cadmium, calcium, manganese, selenium, titanium, tungsten, vanadium, etc. Particularly, magnetite is preferably used in terms of its magnetic property. The magnetic material preferably has an average particle diameter of from about 1 to 2 μm. The average particle diameter includes all values and subvalues therebetween, especially including 1, 1.1, 1.2, 1.3, 1.4, 1.5, 1.6, 1.7, 1.8, and 1.9 μm.

The toner preferably includes the magnetic material in an amount of from 15 to 200 parts by weight, and preferably from 20 to 100 parts by weight per 100 parts by weight of the resins in the toner. The amount of the magnetic material includes all values and subvalues therebetween, especially including 20, 40, 60, 80, 100, 120, 140, 160 and 180 parts by weight per 100 parts by weight of the resins in the toner.

In addition, the present invention relates to a process cartridge containing a developer according to the present invention. The process cartridge has a blade for wiping out developer remaining on the surface of a development part where the developer is used so that an electrostatic latent image formed in the surface of photo conductor can be developed. Further the process cartridge has an electro static charge brush electrifying a surface of the photo conductor, and a photo conductor which can be adapted to the electrophotographic system.

Figure 3:
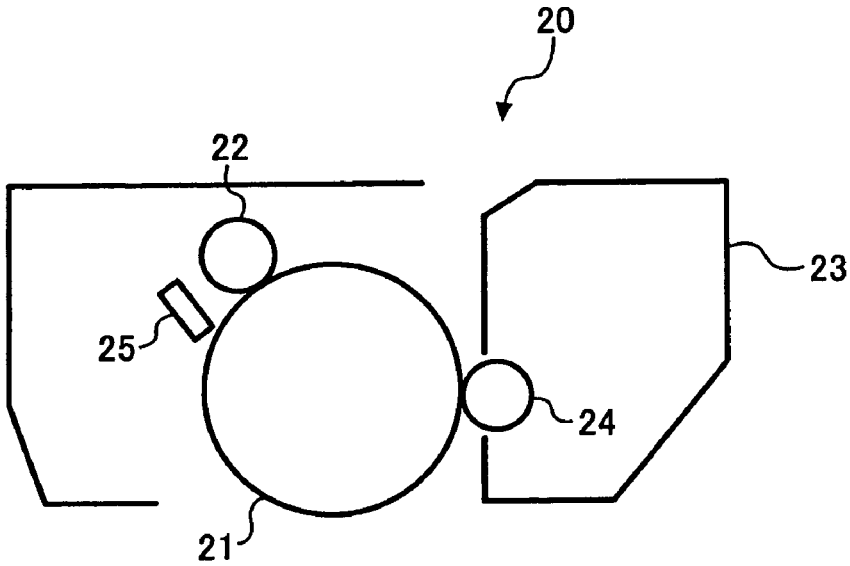
FIG. 3 shows a toner cartridge of the present invention.

The architecture of an image forming device having a process cartridge of the present invention is shown in FIG. 3. The process cartridge of the present invention is removable from the main body of the image forming apparatus. The process cartridge has a cleaning blade as cleaning means to wipe out a developer which remains on the photoconductor's surface, a charge brush as means to electrify the photoreceptor surface, a photoconductor, a developer tank which have developing means as developing portion and developer.

The reference numerals in FIG. 3 have the following meaning: 20 process cartridge (toner cartridge), 21 photo conductor, 22 charging means, 23 developer tank, 24 development means, and 25 cleaning means.

Figure 4:
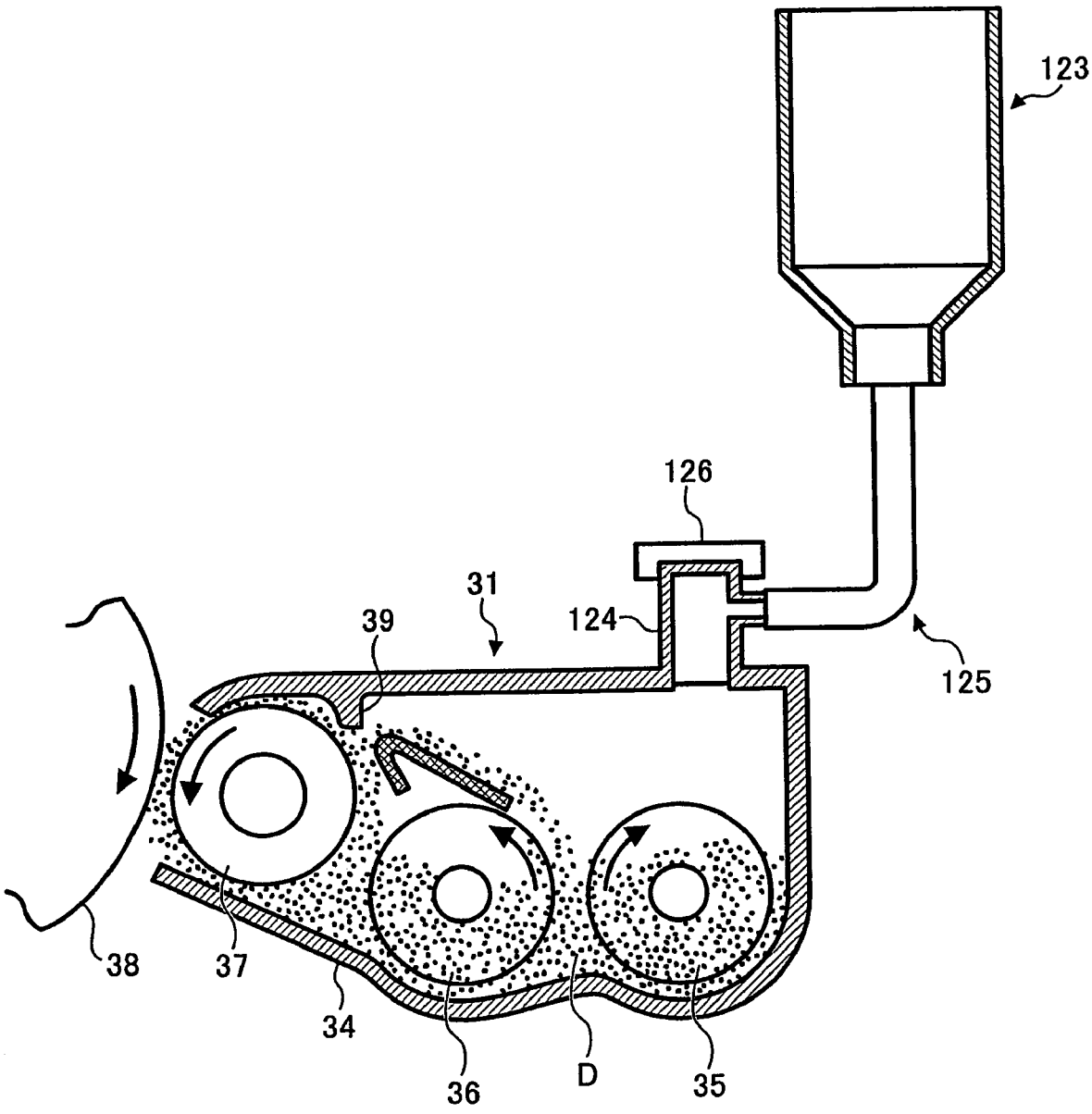
FIG. 4 shows an example of an image forming device equipped with a developer container filled with a developer of the present invention.

FIG. 4 shows one of example on an image forming device equipped with the developer container which is filled with the developer of the present invention. The reference numerals in FIG. 4 have the following meaning: 31 developer part, 34 developer housing, 35 agitation screw one, 36 agitation screw two, 37 developing rollers, 38 photo conductor, 39 image forming apparatus, 123 developer container, 124 connecting devices, 125 developer transportation path, 126 cap, D developer.

In FIG. 4, the developer part 31 has a developer housing 34, a developer container 123 which accommodates the developer (D) of the present invention. The first that it is agitated, and a developer (D) is mixed with and the second agitation screw (35), (36). A sleeve-shaped developing roller 37, means (not shown) to equalize the developer layer of a developing sleeve surface. A developing roller 37 is placed at a distance of less than 0.4 mm to photo conductor 38 opposed to photo conductor 38. Photo conductor 38 is rotationally driven by a direction as shown by the arrow, and an electrostatic latent image is formed on the surface.

Figure 5:
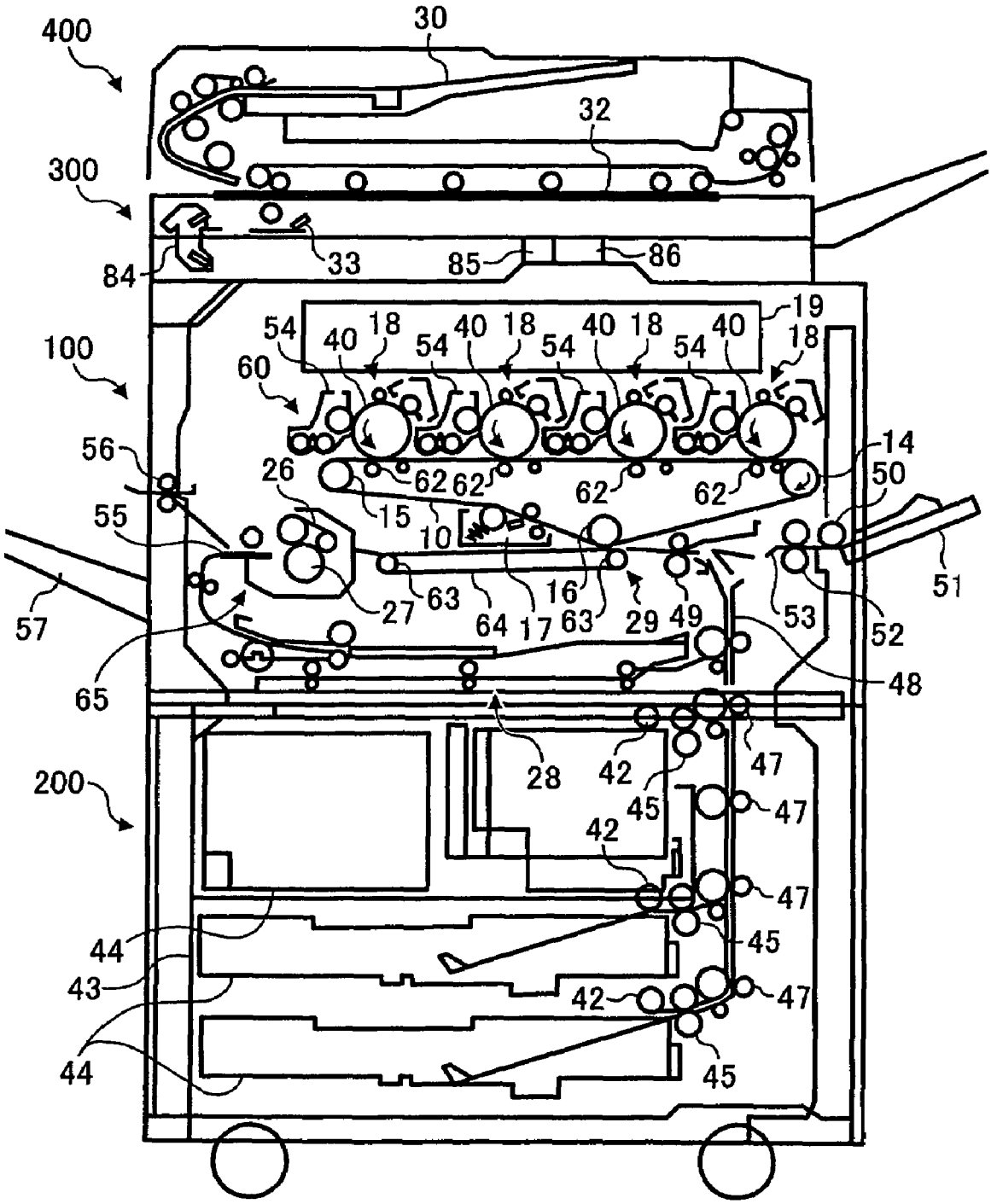
FIG. 5 shows an image forming device using a developer including a carrier of the present invention.

In the following, an image forming device using developer including a carrier of the present invention is explained. FIG. 5 is an outline block-diagram which shows an example of one of the image forming devices according to the present invention. The reference numerals in FIG. 5 have the following meaning: 10 intermediate transfer belt, 14, 15, 16 support rollers, 17 cleaning means, 18 imaging means, 19 exposure equipment, 26 fixing belt, 27 compression belt, 28 inversion apparatus, 29 secondary transcription means, 30 manuscript rest, 32 contact glass, 33 the first traveling body, 40 photo conductor, 42 rollers, 43 paper bank (containing paper feed cassette and paper), 44 paper feed cassette, 45 separation rollers, 47 transportation rollers, 48 paper feeding path, 49 registration roller, 50 paper rollers, 51 manual feeding tray, 52 separation rollers, 53 manual feeding path, 54 development means, 55 switching member (used to turn the paper over to print on both sides), 56 discharge rollers, 57 stacking trays, 60 tandem type image forming unit, 62 primary transcription means, 63 rollers, 64 secondary transcription belt, 65 fixing means, 84 the second traveling body, 85 imaging lens, 86 reading sensor, 100 main body of copying apparatus, 200 paper feed table, 300 scanner, 400 automatic document feeder apparatus (ADF).

In the main body of copying apparatus (100), a tandem type image forming unit (60) which did imaging means (18) comprising each measure performing electrophotography process such as static build-up, development, cleaning around photo conductor (40) as latent image support to four multiple is included.

Exposure equipment (19) which photo conductor (40) is exposed by a laser beam based on the image information, and a latent image is formed in the upper part of a tandem image forming device (60). In addition, an intermediate transfer belt (10) comprising endless belt member is installed in locus opposed to each photo conductor (40) of a tandem image forming unit (60).

In the position opposite to photo conductor (40), there is a primary transcription means (62) which copies toner images of each color formed on photo conductor (40) to an intermediate transfer belt (10). A secondary transcription means (29) copies toner images and places them on top of one another on the intermediate transfer belt (10). The sheet is transported by a paper feed table (200). A secondary transcription belt (64) which is an endless belt is hung between two rollers (63) and a secondary transcription means (29) is included. The sheet is pushed to a support roller (16) through an intermediate transfer belt (10), and toner images on an intermediate transfer belt (10) are copied in transfer onto the paper. Fixing means (65) fixes the image on the paper in transfer. Fixing means (65) is installed at the side of secondary transcription means (29).

Photographic fixing means (65) pushes a compression belt (27) to a photographic fixing belt (26) which is an endless belt. The secondary transcription means (29) has a sheet feeding function which is able to feed the sheet to fixing means (65).

Of course, as the secondary transcription means (29), a transfer roller and a contactless charger may be used. In such a case it becomes difficult to have a sheet feeding function at the same time. In addition, FIG. 5 shows an inversion apparatus (28) under the secondary transcription means (29) and fixing means (65) for printing on both sides of the sheet. The inversion apparatus (28) is parallel with the tandem image forming unit (60).

A developer including the carrier is used as development means (54) of imaging means (18). The development means (54), is used to develop a latent image on photo conductor (40) using an alternating electric field.

The developer is activated by applying the alternating electric field and a narrow charging quantity distribution is achieved resulting in good developing ability.

The development means (54) and photo conductor (40) are in one unit, and there can be a process cartridge detachable form the image forming apparatus. This process cartridge may includes charging means (charging means, for example, rotary brush-shaped with this apparatus in question), cleaning means.

The image forming apparatus operates as follows. Firstly, the manuscript is set on the manuscript rest (30) of an automatic document feeder apparatus (400) or the automatic document feeder apparatus (400) is opened, and the manuscript is set on contact glass (32) of a scanner (300). The automatic document feeder apparatus (400) is closed to hold the manuscript. If start switch (not shown) is pushed, after the manuscript was set on the automatic document feeder apparatus (400), the manuscript is transported, and having moved to the contact glass (32), a scanner (300) is driven and the first traveling body (33) and the second traveling body (84) are run. On the other hand, if manuscript was set on the contact glass (32), a scanner (300) is driven promptly and the first traveling body (33) and the second traveling body (84) are run.

Further, each photoconductor 40 rotates and the charging devices charge each respective photoconductor. The reflected light is also emitted towards each photoconductor 40 based on the image read by the scanner 300, and using a toner included in each developing device, an image is formed on each photoconductor. If the rollers 14, 15, 16 rotate, the transfer belt 10 also rotates. Then, each image from the photoconductors 40 Yellow, 40 Cyan, 40 Magenta and 40 Black transfers to the transfer belt 10 using the primary transcription means 62. The cleaning means 17 cleans the toner remaining on the intermediate transfer belt 10. The discharging device then discharges the photoconductors.

After a paper feeding roller 42 included in the paper feeding table 200 rotates, a separation roller 45 separates a top sheet from an appropriate one of paper feeding cassette 44 of a paper bank 43. The sheet then merges into a paper feeding path (not labeled), and a transportation roller 47 conveys the sheet toward a paper feeding pass 48 to a registration roller 49. Alternatively, the sheet may be inserted via a manual feeding tray 51. A paper roller 50 then conveys the sheet placed on the manual feed tray 51 to the registration roller 49. Further, the registration roller 49 conveys the paper between the intermediate transfer belt 10 and the second transcription means 29. Then, the second transcription means 29 conveys the sheet to the fixing means 65, and after the fixing means 65 fixes the image onto the sheet, the sheet is guided by a switching member 55 toward a discharge roller 56. The discharge roller 56 then discharges the sheet to a stacking tray 57. Further, when a double sided printing mode is selected, the sheet is transferred to the inversion apparatus 28 by the switching member 55, which turns the sheet over for double sided printing. Then, an image on the back of the manuscript is formed on the back of the sheet.

Having generally described the present invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The following Examples are hypothetical examples. In the Examples, "parts" refers to "parts by weight"; "%" refers to "% by weight".

Example 1

Preparation of Carrier 1

A silicon resin (SR2411 made by Toray Dow-Corning Ltd.) is diluted to obtain a silicon resin solution containing 5% of solid. This solution is coated onto 5 kg of carrier core (i) having the characteristics shown in Tables 1-1 and 1-2 below (Cu—Zn ferrite having a $D_w$: 28.1 μm, and a magnetic moment of 56 emu/g at 1 kOe) by using a fluidized bed coating apparatus at a rate of approximately 30 g/min., in an atmosphere at 90° C., and the coating is followed by heating for two hours at 230° C., to obtain carrier C1.

Preparation of Carrier 2

The same method as described for the preparation of carrier 1 is repeated with exception of using carrier core (ii) (Cu—Zn ferrite having a $D_w$: 28.0 μm, and a magnetic moment of 57 emu/g at 1 kOe), to obtain carrier C2.

Preparation of Carrier 3

The same method as described for the preparation of carrier 1 is repeated with exception of using carrier core (iii) (Cu—Zn ferrite having a $D_w$: 27.8 μm, and a magnetic moment of 75 emu/g at 1 kOe), to obtain carrier C3.

Preparation of Carrier 4

The same method as described for the preparation of carrier 1 is repeated with exception of using carrier core (iii) (Cu—Zn ferrite having a $D_w$: 28.6 μm, and a magnetic moment of 78 emu/g at 1 kOe), to obtain carrier C4.

Preparation of Carrier 5

The same method as described for the preparation of carrier 1 is repeated with exception of using carrier core (iv) (Cu—Zn ferrite having a $D_w$: 28.3 μm, and a magnetic moment of 81 emu/g at 1 kOe), to obtain carrier C5.

Preparation of Carrier 6

A silicon resin (SR2411 made by Toray Dow-Corning Ltd.) is diluted to obtain a silicon resin solution containing 2.5% of solid. This solution is coated onto 5 kg of carrier core (vi) having the characteristics shown in Tables 1-1 and 1-2 below by using a fluidized bed coating apparatus at rate of approximately 15 g/min., in an atmosphere at 90° C., and the coating is followed by heating for two hours at 240° C., to obtain a carrier core coated with a 0.08 μm Si high resistance cover layer A. The thickness of the layer is measured by fluorescence X-ray.

The same method as described for the preparation of carrier C5 is repeated with exception of using a carrier core with the high resistance cover layer A. Thus, carrier C6 is obtained.

The resistance of the high resistance cover layer A is Log $R_A$=15.7 Ωcm. The cover layer B is formed on the cover layer A. The resistance of the cover layers A and B is Log Ra=13.6 Ωcm.

Preparation of Carrier 7

A silicon resin (SR2411 made by Toray Dow-Corning Ltd.) is diluted to obtain a silicon resin solution containing 5% of solid. 2.0 wt. % of amino silane coupling agent $H_2N(CH)_2Si(OC_2H_5)_3$ is added to the solution. This solution is coated onto 5 kg of carrier core (v) having the characteristics shown in Tables 1-1 and 1-2 below by using a fluidized bed coating apparatus at rate of approximately 30 g/min., in an atmosphere at 90° C., and the coating is followed by heating for two hours at 230° C. Thus, carrier C7 is obtained.

Preparation of Carrier 8

The same method as described for the preparation of carrier 1 is repeated with exception of using carrier core (vi) (Cu—Zn ferrite having a $D_w$: 28.6 μm, and a magnetic moment of 58 emu/g at 1 kOe), to obtain carrier C11.

Preparation of Carrier 9

The same method as described for the preparation of carrier 1 is repeated with exception of using carrier core (vii) (Cu—Zn ferrite having a $D_w$: 33.9 μm, and a magnetic moment of 59 emu/g at 1 kOe), to obtain carrier C12.

Preparation of Carrier 10

The same method as described for the preparation of carrier 1 is repeated with exception of using carrier core (viii) having characteristics (Cu—Zn ferrite having a $D_w$: 33.4 μm, and a magnetic moment of 58 emu/g at 1 kOe), thus carrier C13 is obtained.

TABLE 1-1

| carrier core | Weight average diameter Dw [μm] | Magnetic moment [emu/g] |
|---|---|---|
| carrier core (i) | 28.1 | 56 |
| carrier core (ii) | 28.0 | 57 |
| carrier core (iii) | 27.8 | 75 |
| carrier core (iv) | 28.6 | 78 |
| carrier core (v) | 28.3 | 81 |
| carrier core (vi) | 28.6 | 58 |
| carrier core (vii) | 33.9 | 59 |
| carrier core (viii) | 33.4 | 58 |

TABLE 1-2

| | carrier core | Weight average diameter $D_w$ [μm] | content ratio[wt. %] of particles having a diameter of 20 μm and below | content ratio[wt. %] of particles having a diameter of 36 μm and below | content ratio[wt. %] of particles having a diameter of 44 μm and below | Magnetic moment [emu/g] | Density of carrier core [g/cm$^3$] | carrier resistance Log R [Ω · cm] | Coating of carrier core | amino silane coupling agent |
|---|---|---|---|---|---|---|---|---|---|---|
| C1 | carrier core (i) | 28.7 | 3.8 | 93.7 | 96.4 | 56 | 2.22 | 15.2 | non | — |
| C2 | carrier core (ii) | 28.6 | 4.1 | 95.1 | 99.2 | 57 | 2.21 | 15.1 | non | — |
| C3 | carrier core (iii) | 28.3 | 4.4 | 94.8 | 99.1 | 75 | 2.17 | 15.3 | non | — |
| C4 | carrier core (iv) | 29.1 | 3.9 | 95.2 | 98.9 | 78 | 2.41 | 14.8 | non | — |
| C5 | carrier core (v) | 28.8 | 4 | 93.8 | 99.3 | 81 | 2.42 | 13.1 | non | — |
| C6 | carrier core (v) | 28.8 | 4 | 93.8 | 99.3 | 81 | 2.42 | 12.9 | yes | — |
| C7 | carrier core (v) | 28.8 | 4 | 93.8 | 99.3 | 81 | 2.42 | 13.7 | non | 2.0 parts |
| C11 | carrier core (vi) | 29.2 | 7.6 | 88.4 | 95.5 | 58 | 2.56 | 11.7 | non | — |
| C12 | carrier core (vii) | 34.4 | 2.7 | 89.1 | 96.7 | 59 | 2.31 | 15.6 | non | — |
| C13 | carrier core (viii) | 33.9 | 2.4 | 92.6 | 98.3 | 58 | 2.44 | 15.9 | non | — |

MANUFACTURING EXAMPLES OF TONER

Manufacturing Example 1 of Toner 100 parts of styrene acrylic resin A, 10 parts of carnauba wax from which free fatty acids are removed (Tg: 83° C.), and 10 parts of carbon black (carbon black # 44 made by Mitsubishi Chemical Corporation) are sufficiently mixed with a HENSCHEL MIXER and then fused and kneaded by a twin-screw extruder. The kneading temperature in the twin-screw extruder is set at a low temperature at which, however, the kneaded substance melts. The temperature of the kneaded substance at the outlet of the twin-screw extruder is 120° C.

Subsequent to cooling, the resulting product is coarsely pulverized by a mill, and classified by an air separator. The thus obtained mother toner particles have a Dw of 5.6 μm and Dw/Dn=1.13. The amount of particles having a diameter of 3 μm or below is 22.0 wt. %. The amount of particles having a diameter of 16 μm or more is 4.3 wt. %.

Further, 0.5 wt. % of hydrophobic silica particles and 0.3 wt. % of Ti oxide are added to mother toner particles. The toner T1 is thus obtained.

Manufacturing Example 2 of Toner

Manufacturing Example 1 is repeated except the mother toner obtained by classifying has a Dw=5.8 μm and Dw/Dn=1.20. The amount of particles having a diameter of 3 μm or less is 18.3 wt. %. The amount of particles having a diameter of 16 μm or more is 4.5 wt. %. Thus, toner T2 is obtained.

Manufacturing Example 3 of Toner

Manufacturing Example 1 is repeated except the mother toner obtained by classifying has a Dw=4.9 μm and Dw/Dn=1.15. The amount of particles having a diameter of 3 μm or less is 17.8 wt. %. The amount of particles having a diameter of 16 μm or more is 2.1 wt. %, and toner T3 is obtained.

Manufacturing Example 4 of Toner

Manufacturing Example 1 is repeated except 100 parts of polyester resin A are used instead of 100 parts of styrene acrylic resin A. The mother toner obtained by classifying has a Dw=5.3 μm and Dw/Dn=1.12. The amount of particles having a diameter of 3 μm or less is 18.1 wt. %. The amount of particles having a diameter of 16 μm or more is 2.5 wt. %, and toner T4 is obtained.

Manufacturing Example 5 of Toner

Manufacturing Example 1 is repeated except 63 parts of polyester resin A and 27 parts of crystalline polyester B having formula (1) ([—O—CO—$CR^1$=$CR^2$—CO—O—$(CH_2)_n$—]$_m$ in which n, m are the number of repeating units, $R^1$, $R^2$ are each a hydrocarbon group) are used instead of 100 parts of styrene acrylic resin A. The mother toner obtained by classifying has a Dw=5.7 μm and Dw/Dn=1.17. The amount of particles having a diameter of 3 μm or less is 18.9 wt. %. The amount of particles having a diameter of 16 μm or more is 2.7 wt. %, and toner T5 is obtained. Phase separation is observed by TEM. Polyester B has a $F_{1/2}$ temperature that is 24° C. lower than that of polyester A.

Manufacturing Example 6 of Toner

Manufacturing Example 5 is repeated except using a 20° C. higher kneading temperature and the temperature of the kneaded substance is 140° C. at the exit of the twin-screw extruder. The mother toner obtained by classifying has a Dw=5.4 μm and Dw/Dn=1.14. The amount of particles having a diameter of 3 μm or less is 18.7 wt. %. The amount of particles having a particle diameter of 16 μm or more is 2.4 wt. %, and toner T6 is obtained. The obtained toner is observed by TEM but phase separation is not observed by TEM Manufacturing Example 7 of Toner Manufacturing Example 1 is repeated except the mother toner obtained by classifying has a Dw=5.9 μm and a ratio of Dw/Dn=1.28. The amount of particles having a diameter 3 μm or less is 22.3 wt. %. The amount of particles having a particle diameter of 16 μm or more is 3.3 wt. %, and toner T11 is obtained.

Manufacturing Example 8 of Toner

Manufacturing Example 1 is repeated except the mother toner obtained by classifying has a Dw=7.9 μm and Dw/Dn=1.18. The amount of particles having a diameter of 3 μm or less is 14.2 wt. %. The amount of particles having a particle diameter of 16 μm or more is 4.9 wt. %, and toner T12 is obtained.

Manufacturing Example 9 of Toner

Manufacturing Example 1 is repeated except the mother toner obtained by classifying has a Dw=1.8 μm and Dw/Dn=1.09. The amount of particles having a diameter of 3 μm or less is 98.4 wt. %. The amount of particles having a particle diameter of 16 μm or more is 0.1 wt. %, and toner T13 is obtained.

TABLE 2

| | Dw [μm] | Dw/Dn | content ratio [wt. %] of particles having a diameter of 3 μm or below | content ratio [wt. %] of particles having a diameter of 16 μm or more | binder resin | crystallinity of polyester | phase separation structure |
|---|---|---|---|---|---|---|---|
| T1 | 5.6 | 1.13 | 22 | 4.3 | styrene acrylic resin A | — | — |
| T2 | 5.8 | 1.2 | 18.3 | 4.5 | styrene acrylic resin A | — | — |
| T3 | 4.9 | 1.15 | 17.8 | 2.1 | styrene acrylic resin A | — | — |

TABLE 2-continued

| | Dw [μm] | Dw/Dn | content ratio [wt. %] of particles having a diameter of 3 μm or below | content ratio [wt. %] of particles having a diameter of 16 μm or more | binder resin | crystallinity of polyester | phase separation structure |
|---|---|---|---|---|---|---|---|
| T4 | 5.3 | 1.12 | 18.1 | 2.5 | polyester A<br>polyester B | none | — |
| T5 | 5.7 | 1.17 | 18.9 | 2.7 | polyester A<br>polyester B | polyester B | yes |
| T6 | 5.4 | 1.14 | 18.7 | 2.4 | polyester A | polyester B | no |
| T11 | 5.9 | 1.28 | 22.3 | 3.3 | styrene<br>acrylic resin A | — | — |
| T12 | 7.9 | 1.18 | 14.2 | 4.9 | styrene<br>acrylic resin A | — | — |
| T13 | 1.8 | 1.09 | 98.4 | 0.1 | styrene<br>acrylic resin A | — | — |

Manufacture Example 1 of Developer 97.5 parts of carrier is mixed in a tubular mixer with 2.5 parts of toners made in the above manufacturing examples to obtain developer D1-D18. The combination of carrier and toner for each developer is shown in Table 3 below.

TABLE 3

| | D1 | D2 | D3 | D4 | D5 | D6 | D7 | D8 | D9 | D10 | D11 | D12 | D13 | D14 | D15 | D16 | D17 | D18 |
|---|---|---|---|---|---|---|---|---|---|---|---|---|---|---|---|---|---|---|
| carrier | C1 | C2 | C2 | C2 | C2 | C2 | C2 | C2 | C2 | C2 | C11 | C12 | C13 | C3 | C4 | C5 | C6 | C7 |
| toner | T1 | T1 | T11 | T12 | T13 | T2 | T3 | T4 | T5 | T6 | T1 | T1 | T1 | T1 | T1 | T1 | T1 | T1 |

Characterization of Developer

Images formed using the developer D1-D18 are evaluated in terms of picture quality and reliability tests. The images are produced using Imagio Color 4000 manufactured by Ricoh Company Ltd. (a digital color copying machine/printer) under the following conditions.

Development gap (a photo conductor-developing sleeve): 0.35 mm.

Doctor gap (a developing sleeve-doctor): 0.65 mm.

Photo conductor linear velocity: 200 mm/sec.

Photo conductor linear velocity: 200 mm/sec.

Developing sleeve linear velocity/photo conductor linear velocity: 1.80.

Insertion apparent density of board: 600 dpi.

Charging potential (Vd): −600 V.

Potential difference (Vl) after exposure to light of portion equal to pictorial image part (close typesetting manuscript): −150 V.

Developing bias: DC-500V/alternating electric current bias component:

2kHZ, −100V to −900V, 50% duty.

Evaluations of the images reproduced are conducted on transferring paper sheets, while evaluations of carrier depositions are conducted by observation of the condition of the photosensitive member after development and before transferring.

The following methods are used for characterization.

(1) Image Density 5 images located in central parts of every 30 mm×30 mm solid image areas reproduced in above described conditions are measured using a X-Rite 938 spectral densitometer, to calculate an average value of the density.

(2) Evaluation of Uniformity of Highlight Area

The granularity (range of lightness of from 50 to 80) defined by Equation 5 is measured.

$$\text{Granularity}=\exp(aL+b)\int((WS(f))^{1/2}VTF(f))df \quad \text{(equation 5)}$$

wherein

L: average brightness, f: spatial frequency (cycle/mm),

WS (f): luminance variation of power spectrum of brightness shift,

VTF (f): visual frequency characteristic, a, b: factors,

The granularity is evaluated on the following scale of 1 to 10 (rank 1 to 10, rank 10 being the best rank):

rank 10: granularity of −0.10~0, rank 9: granularity of 0~0.05, rank 8: granularity of 0.05~0.10, rank 7: granularity of 0.10~0.15, rank 6: granularity of 0.15~0.20, rank 5: granularity of 0.20~0.25, rank 4: granularity of 0.25~0.30, rank 3: granularity of 0.30~0.40, rank 2: granularity of 0.40~0.50, rank 1: granularity of 0.50 or more.

(3) Background Fouling of the Image

The background fouling of the image under the development conditions is evaluated on a scale of 1 to 10, a high rank referring to little background fouling of the image, and rank 10 being the best rank.

Assessment Procedure

The number of toner particles adhering to the background part (non-pictorial image part) of the sheet is counted. It is converted into number of particles adhered per $cm^2$ and the background fouling is evaluated according to the following ranks:

rank 10: 0~36 toner particles/$cm^2$,
rank 9: 37~72 toner particles/$cm^2$,
rank 8: 73~108 toner particles/$cm^2$,
rank 7: 109~144 toner particles/$cm^2$,
rank 6: 145~180 toner particles/$cm^2$,
rank 5: 181~216 toner particles/$cm^2$,
rank 4: 217~252 toner particles/$cm^2$,
rank 3: 253~288 toner particles/$cm^2$,
rank 2: 289~324 toner particles/$cm^2$,
rank 1: 325 or more toner particles/$cm^2$.

(4) Carrier Deposition; Electric Potential of Background Area

Generation of carrier depositing causes the flaws on photosensitive drum or fixing roller, therefore decreases image quality. As only one part of deposited carriers are in general transferred to the transferring paper, the carrier deposition states are directly observed on photosensitive drum. A pictorial image pattern is made by a 2 dot line (100 lines per inch) in a sub-scover direction. A bias current of 400V is applied, and the image is developed afterwards. The number of carrier particles which adhere between two lines is counted in an area of 100 $cm^2$ by transferring the particles onto sticky tape. The adhesion of carrier particles is evaluated on a scale of 1 to 10 (Rank 1 to 10, rank 10 being the best.)

rank 10: 0,
rank 9: less than 10 particles,
rank, 8: 11~20 particles,
rank 7: 21~30 particles,
rank 6: 31~50 particles,
rank 5: 51~100 particles,
rank 4: 101~300 particles,
rank 3: 301~600 particles,
rank 2: 601~1000 particles,
rank 1: 1000 particles or more.

(5) Low-Temperature Fixibility:

The fixing temperature is changed, and cold offset temperature (fixing lower limit temperature) is obtained. The lower limit of the fixing temperature of a conventional low-temperature fixing toner is around 140-150° C. For the evaluation of low-temperature fixing, the following conditions are used: velocity of a paper feed 120-150 mm/sec, bearing 1.2 kgf/$cm^2$, and nip 3 mm wide. The high-temperature offset is evaluated under the following conditions: set linear velocity of a paper feed 50 mm/sec, bearing 2.0 kgf/$cm^2$, and nip 4.5 mm wide.

The results of each test are shown below. The low temperature fixation characteristic is evaluated on a scale of 1 to 5.

rank 5: less than 130° C.
rank 4: 130~140° C.
rank 3: 140~150° C.
rank 2: 150~160° C.
rank 1: 160° C. or more.

(6) Background Fouling after 20 k Run:

The initially, at the starting time, applied toner is gradually consumed while printing a letters image chart having a 6% ratio of image area on 50,000 paper sheets. The smear is evaluated for the 50,000 the paper sheet on a scale of 1 to 10 as in the evaluation of the background fouling in (3).

TABLE 4

| | developer | carrier | toner | image density | halftone uniformity | back-ground fouling (rank) | carrier adhesion (rank) | low temperature fixation characteristic (rank) | back-ground fouling after 20k run (rank) |
|---|---|---|---|---|---|---|---|---|---|
| Example 1 | D1 | C1 | T1 | 1.61 | 5 | 7 | 5 | 3 | 6 |
| Example 2 | D2 | C2 | T1 | 1.62 | 6 | 7 | 6 | 3 | 6 |
| Comparative Example 1 | D3 | C2 | T11 | 1.67 | 5 | 4 | 6 | 3 | 2 |
| Comparative Example 2 | D4 | C2 | T12 | 1.58 | 3 | 7 | 6 | 3 | 6 |
| Comparative Example 3 | D5 | C2 | T13 | 1.71 | 8 | 2 | 6 | 3 | 1 |
| Example 3 | D6 | C2 | T2 | 1.63 | 6 | 8 | 6 | 3 | 7 |
| Example 4 | D7 | C2 | T3 | 1.61 | 8 | 8 | 6 | 3 | 7 |
| Example 5 | D8 | C2 | T4 | 1.67 | 8 | 8 | 6 | 4 | 7 |
| Example 6 | D9 | C2 | T5 | 1.62 | 8 | 8 | 6 | 5 | 7 |
| Example 7 | D10 | C2 | T6 | 1.60 | 8 | 8 | 6 | 4 | 7 |
| Comparative Example 4 | D11 | C11 | T1 | 1.66 | 6 | 7 | 2 | 3 | 5 |
| Comparative Example 5 | D12 | C12 | T1 | 1.59 | 2 | 7 | 2 | 3 | 5 |
| Comparative Example 6 | D13 | C13 | T1 | 1.60 | 3 | 7 | 3 | 3 | 6 |
| Example 8 | D14 | C3 | T1 | 1.62 | 6 | 7 | 7 | 3 | 6 |
| Example 9 | D15 | C4 | T1 | 1.63 | 6 | 7 | 8 | 3 | 6 |
| Example 10 | D16 | C5 | T1 | 1.62 | 6 | 7 | 9 | 3 | 6 |
| Example 11 | D17 | C6 | T1 | 1.64 | 6 | 8 | 9 | 3 | 7 |
| Example 12 | D18 | C7 | T1 | 1.62 | 6 | 7 | 9 | 3 | 7 |

Japanese patent application JP 2004-263319 filed Sep. 10, 2004, and Japanese patent application JP 2005-240531 filed Aug. 23, 2005, are incorporated herein by reference.

Numerous modifications and variations on the present invention are possible in light of the above teachings. It is therefore to be understood that within the scope of the appended claims, the invention may be practiced otherwise than as specifically described herein.

The invention claimed is:

1. A two-component developer for electro-photography, comprising:

(A) a carrier comprising a core comprising a magnetic material, said core being coated with at least one resin layer; and (B) a toner;

wherein said carrier has a weight average particle diameter Dw of 22-32 μm;

wherein a content of carrier particles having a diameter smaller than 20 μm is 0-7% by weight based on the weight of the carrier;

wherein a content of carrier particles having a diameter smaller than 36 μm is 90-100% by weight based on the weight of the carrier;

wherein a weight average particle diameter Dw of the toner is 2-7 μm; and wherein a ratio Dw/Dn of the weight average particle diameter of the toner to the number average particle diameter of the toner is 1.00-1.25.

2. The developer as claimed in claim 1, wherein an amount of carrier particles having a diameter smaller than 44 μm is 98-100% by weight based on the weight of the carrier.

3. The developer as claimed in claim 1, wherein an amount of carrier particles having a diameter smaller than 20 μm is 0-5% by weight based on the weight of the carrier.

4. The developer as claimed in claim 1, wherein an amount of toner particles having a diameter of less than or equal to 3 μm is less than 20% by weight based on the weight of the toner.

5. The developer as claimed in claim 1, wherein an amount of toner particles having a diameter of more than 16 μm is 3% by weight based on the weight of the toner.

6. The developer as claimed in claim 1, wherein said carrier has a magnetic moment of 70 to 150 emu/g in a magnetic field of 1 kOe.

7. The developer as claimed in claim 1, wherein said carrier has a bulk density of 2.35 to 2.50 g/cm$^3$.

8. The developer as claimed in claim 1, wherein said carrier has a Log R value of 12.0 to 14.0 Ω·cm, wherein R is the resistance of the carrier.

9. The developer as claimed in claim 1, wherein said carrier is coated with a first resin layer;

wherein a second resin layer is coated on said first resin layer;

wherein said second resin layer has a resistivity which is lower than the resistivity of said first resin layer.

10. The developer as claimed in claim 1, wherein said carrier is coated with a resin layer comprising a silicone resin.

11. The developer as claimed in claim 1, wherein said the toner comprises at least one polyester resin.

12. The developer as claimed in claim 11, wherein said polyester resin is crystalline and is at least one member selected from the group consisting of compounds represented by formula (1)

$$[—O—CO—CR_1{=}CR_2—CO—O—(CH_2)_n—]_m \quad (1)$$

n, m are the number of repeating units, $R^1$, $R^2$ are each a hydrogen or a hydrocarbon group.

13. The developer as claimed in claim 1, wherein said toner comprises at least two polyester resins which phase separate, wherein a first polyester resin is crystalline and a second polyester resin has a $F^{1/2}$ temperature which is higher than the $F^{1/2}$ temperature of the first polyester resin.

14. The developer as claimed in claim 1, wherein said magnetic material is a ferromagnetic material selected form the group consisting of Fe, magnetite, Mn—Mg—Sr ferrite, Mn ferrite and mixtures thereof.

15. The developer as claimed in claim 1, wherein said carrier is coated with a resin layer comprising a silicone resin and an aminosilane coupling agent.

16. A method for developing an electro-photographic latent image, comprising:

developing said latent image with the developer as claimed in claim 1 in an electro-photographic imaging apparatus.

17. The method as claimed in claim 16, wherein said electro-photographic imaging apparatus comprises a photoconductor and developing roller at a distance of 0.4 mm or less.

18. The method as claimed in claim 16, wherein a DC voltage is applied as a developing bias.

19. A process cartridge, comprising:

a photo conductor, a charging brush, a development part comprising the developer as claimed in claim 1, and a blade.

20. An electro-photographic imaging apparatus, comprising:

a photoconductor, a charging means, an image exposure means, a development means, a transfer means, a cleaning means, and a development part comprising the developer as claimed claim 1.

* * * * *